US008555890B2

(12) United States Patent
Hiebert

(10) Patent No.: US 8,555,890 B2
(45) Date of Patent: Oct. 15, 2013

(54) SURGICAL POSITIONING SYSTEM

(75) Inventor: Eugene Lloyd Hiebert, Salem, OR (US)

(73) Assignee: HUG-U-VAC Surgical Positioning Systems, Inc., Salem, OR (US)

( * ) Notice: Subject to any disclaimer, the term of this patent is extended or adjusted under 35 U.S.C. 154(b) by 70 days.

(21) Appl. No.: 13/364,093

(22) Filed: Feb. 1, 2012

(65) Prior Publication Data

US 2013/0192608 A1 Aug. 1, 2013

(51) Int. Cl.
*A61G 15/00* (2006.01)

(52) U.S. Cl.
USPC ..... 128/845; 128/846; 5/713

(58) Field of Classification Search
USPC ..... 128/845–846, 869–870; 602/13, 19; 5/621, 628, 630, 633, 634, 694, 708, 5/713
See application file for complete search history.

(56) References Cited

U.S. PATENT DOCUMENTS

| | | | | |
|---|---|---|---|---|
| 3,212,497 | A | 10/1965 | Dickinson | |
| 3,762,404 | A | 10/1973 | Sakita | |
| 4,234,982 | A | 11/1980 | Bez et al. | |
| 4,657,003 | A | 4/1987 | Wirtz | |
| 4,862,879 | A | 9/1989 | Coombs | |
| 4,885,811 | A | 12/1989 | Hayes | |
| 4,962,769 | A | 10/1990 | Garcia | |
| 4,999,867 | A | 3/1991 | Toivio et al. | |
| 5,121,756 | A | 6/1992 | Koledin | |
| 5,154,185 | A | 10/1992 | Latimer et al. | |
| 5,443,488 | A | 8/1995 | Namenye et al. | |
| D362,913 | S | 10/1995 | Eisenberg et al. | |
| 5,586,348 | A | 12/1996 | Toivio et al. | |
| 5,621,934 | A | 4/1997 | Olkkonen et al. | |
| 5,626,150 | A | 5/1997 | Johnson et al. | |
| 5,634,222 | A | 6/1997 | Zwickey | |
| 5,647,079 | A | 7/1997 | Hakamium | |
| 5,659,908 | A | 8/1997 | Nishino | |
| 5,906,205 | A * | 5/1999 | Hiebert | 128/845 |
| 5,986,243 | A | 11/1999 | Campf | |
| 6,215,111 | B1 | 4/2001 | Rock et al. | |
| 6,318,372 | B1 * | 11/2001 | Hiebert | 128/869 |
| 7,319,207 | B2 | 1/2008 | Campf et al. | |
| 7,959,658 | B2 | 6/2011 | Fields et al. | |
| 2005/0060806 | A1 | 3/2005 | Wilkinson | |
| 2011/0047706 | A1 | 3/2011 | Hiebert | |
| 2011/0126355 | A1 | 6/2011 | Hiebert | |
| 2011/0191960 | A1 | 8/2011 | Hiebert | |

OTHER PUBLICATIONS

International Search Report from correspoding International Application No. PCT/US2013/024180, dated May 7, 2013.
Written Opinion of the International Searching Authority from International Application No. PCT/US2013/024180, dated May 7, 2013.

(Continued)

*Primary Examiner* — Michael A. Brown
(74) *Attorney, Agent, or Firm* — Klarquist Sparkman, LLP

(57) ABSTRACT

Described herein are exemplary embodiments of improved surgical positioners that not only help position a patient during surgery, but also help maintain the patient's body temperature during surgery. Some exemplary surgical positioning devices disclosed herein comprise a flexible shell defining a deflatable air-tight internal region partially filled with beads and an electrical warming fabric coupled to an internal surface of the shell that is adjacent to the patient. The warming fabric is configured to convert electrical current into heat for warming the patient during surgery.

20 Claims, 18 Drawing Sheets

(56) References Cited

OTHER PUBLICATIONS

Augustine Biomedical & Design; "Hot Dog®," http://vetwarming.com/technology.php, 2 pp. (obtained Jan. 31, 2012).
Natus, Olympic Papoose Boards, http://www.natus.com/index.cfm?pa . . . , 2 pp. (obtained Jun. 17, 2010).
Natus, Olympic Vac-Pac, http://www.natus.com/index.cfm?pa . . . , 2 pp. (obtained Jun. 17, 2010).
Schroer Manufacturing Company, Shor-line® catalog; "Vacu-Positioner," 3 pp., p. G1 (1987).
Schroer Manufacturing Company, Shore-line® catalog; "Vacu-Positioner," p. F20 Sep. 1998).
SW Med-Source, http://www.swmedsource.com/bean . . . , 6 pp. (obtained Jun. 17, 2010).
ThermoGear™ Inc., http://www.thermogear.com, 1 p. (obtained Jan. 31, 2012).

* cited by examiner

SURGICAL POSITIONING SYSTEM

FIELD

This disclosure relates to an improved positioning system for supporting and heating a patient during medical treatment.

BACKGROUND

Vacuum actuated positioning aids or devices are utilized in the operating room for positioning patients in the supine, prone and lateral positions. They are frequently used when the patient is in the lateral position, i.e., on his or her side, for a multitude of surgical procedures, such as brain, chest, kidney, shoulder and hip surgery, to name a few. The devices typically comprise a flexible air impervious bag containing small particles or beads which consolidate into a rigid mass when the bag is evacuated.

More specifically, devices of this type typically are filled with thousands of tiny, elastically deformable, generally spherical, polystyrene or plastic beads. When the device is in the soft (unevacuated) condition, the beads are free to move around so that the device can be molded to the patient's body. When air is removed (using a vacuum source), atmospheric pressure forces the beads together into a solid mass, positioning yet immobilizing the patient in the selected position. Allowing air back into the device returns it to its initial soft condition, ready for re-use. These positioning devices, sometimes referred to as bean bag positioners, typically have a generally square or rectangular shape and in some cases are provided with a U-shaped shoulder cutout located centrally along one edge.

Fabric-style devices also are used for positioning patients during exam or treatment. These devices typically are wrapped around one or more sections of the patient, and include one or more wide canvas flaps with adjustable Velcro™ straps. The flaps may be detached/unwrapped to allow a particular area of the patient to be selectively exposed for treatment. Foam pads and other positioning aids also are used to reduce pressure points and provide patient support during surgery.

During surgery, a patient's body temperature may drop, especially if the patient is in a state where the hypothalamus is not operative and the patient lacks the ability to shiver to generate heat. A standard way of regulating the patient's body temperature involves blowing warm air over the patient during surgery. In one example, a disposable paper double-layered blanket is placed over the top of a patient lying on an operating table. The bottom layer of the blanket includes several holes adjacent to the patient's skin. Warm air is blown into the blanket between the two layers and the warm air passes through the holes and warms the patient. However, the warm air blowing on the patient may not be sterile and can introduce contaminants to the operating area. In addition, this kind of warming blanket only warms the top surfaces of the patient and presents a waste and cost problem since the paper blankets must be disposed of after each operation. Thus, there is a need for an improved system to warm a patient during surgery.

There is also a need for an improved positioning system for surgery, especially surgeries in which the patient is supported on an inclined surgery table as, for example, when the patient is in the Trendelenburg, Reverse Trendelenburg or Lateral Oblique positions. Accordingly, it is desirable to provide an improved positioning and warming system for patients during surgery.

SUMMARY

Described herein are exemplary embodiments of improved surgical positioners that not only help position a patient during surgery, but also help maintain the patient's body temperature or otherwise warm the patient during surgery.

Some exemplary surgical positioning devices disclosed herein comprise a flexible shell defining a deflatable air-tight internal region partially filled with beads and an electrical warming material, or fabric, coupled to the shell. The electrical warming material can be coupled to an internal surface of the shell that is adjacent to the patient. The warming fabric is configured to convert electrical current, such as DC current, into heat for warming the patient during surgery.

In some embodiments, the device further comprises an electrical power cord coupled at a first end to the electrical warming fabric and couplable at a second end to an electrical power source. The cord can have an intermediate portion passing through the shell at an air-tight, or hermetically sealed, seam between upper and lower shell walls. In some of these embodiments, the electrical power cord further comprises a heat controller configured to control the amount of heat produced by the electrical warming fabric and/or an AC-to-DC converter.

In some embodiments, the electrical warming fabric comprises an upper surface in contact with the lower surface of an upper wall of the shell. The device further comprising an adhesive layer positioned within the shell and covering the lower surface of the electrical warming fabric. The adhesive layer can comprising a peripheral portion that extends beyond lateral edges of the electrical warming fabric and is adhered to the lower surface of the upper wall of the shell around the warming fabric, such that the adhesive layer separates the electrical warming fabric from the beads and secures the electrical warming fabric to the upper wall of the shell.

Some embodiments of the device are configured for human patients and others are configured for non-human animal patients.

Some exemplary methods related to the disclosed positioners comprise: positioning a surgical positioner between a patient and a support surface with the patient being in a selected position for surgery, the positioner comprising a shell, an electrical warming material coupled to an internal surface of the shell, and a plurality of beads within the shell; evacuating air from the shell such that the positioner fittingly engages lower and side portions of the patient to hold the patient in the selected position; and supplying direct electrical current to the electrical warming material to warm the patient through the shell of the positioner.

Some methods further comprise adjusting the electrical current to the electrical warming material to maintain the patient's body temperature within a selected range.

In some methods, supplying direct electrical current to the electrical warming fabric comprises converting alternating electrical current to direct electrical current.

The foregoing and other objects, features, and advantages of the invention will become more apparent from the following detailed description, which proceeds with reference to the accompanying figures.

DETAILED DESCRIPTION

General Considerations

For purposes of this description, certain aspects, advantages, and novel features of the embodiments of this disclosure are described herein. The disclosed methods, apparatuses, and systems should not be construed as limiting in any way. Instead, the present disclosure is directed toward all novel and nonobvious features and aspects of the various disclosed embodiments, alone and in various combinations and sub-combinations with one another. The methods, apparatuses, and systems are not limited to any specific aspect or feature or combination thereof, nor do the disclosed embodiments require that any one or more specific advantages be present or problems be solved.

Although the operations of some of the disclosed methods are described in a particular, sequential order for convenient presentation, it should be understood that this manner of description encompasses rearrangement, unless a particular ordering is required by specific language. For example, operations described sequentially may in some cases be rearranged or performed concurrently. Moreover, for the sake of simplicity, the attached figures may not show the various ways in which the disclosed methods can be used in conjunction with other methods.

As used herein, the terms "a", "an" and "at least one" encompass one or more of the specified element. That is, if two of a particular element are present, one of these elements is also present and thus "an" element is present. The terms "a plurality of" and "plural" mean two or more of the specified element.

As used herein, the term "and/or" used between the last two of a list of elements means any one or more of the listed elements. For example, the phrase "A, B, and/or C" means "A," "B," "C," "A and B," "A and C," "B and C" or "A, B and C."

As used herein, the term "coupled" generally means mechanically, chemically, or otherwise physically coupled or linked and does not exclude the presence of intermediate elements between the coupled or associated items absent specific contrary language.

Exemplary Surgical Positioning Systems

Figure 1:
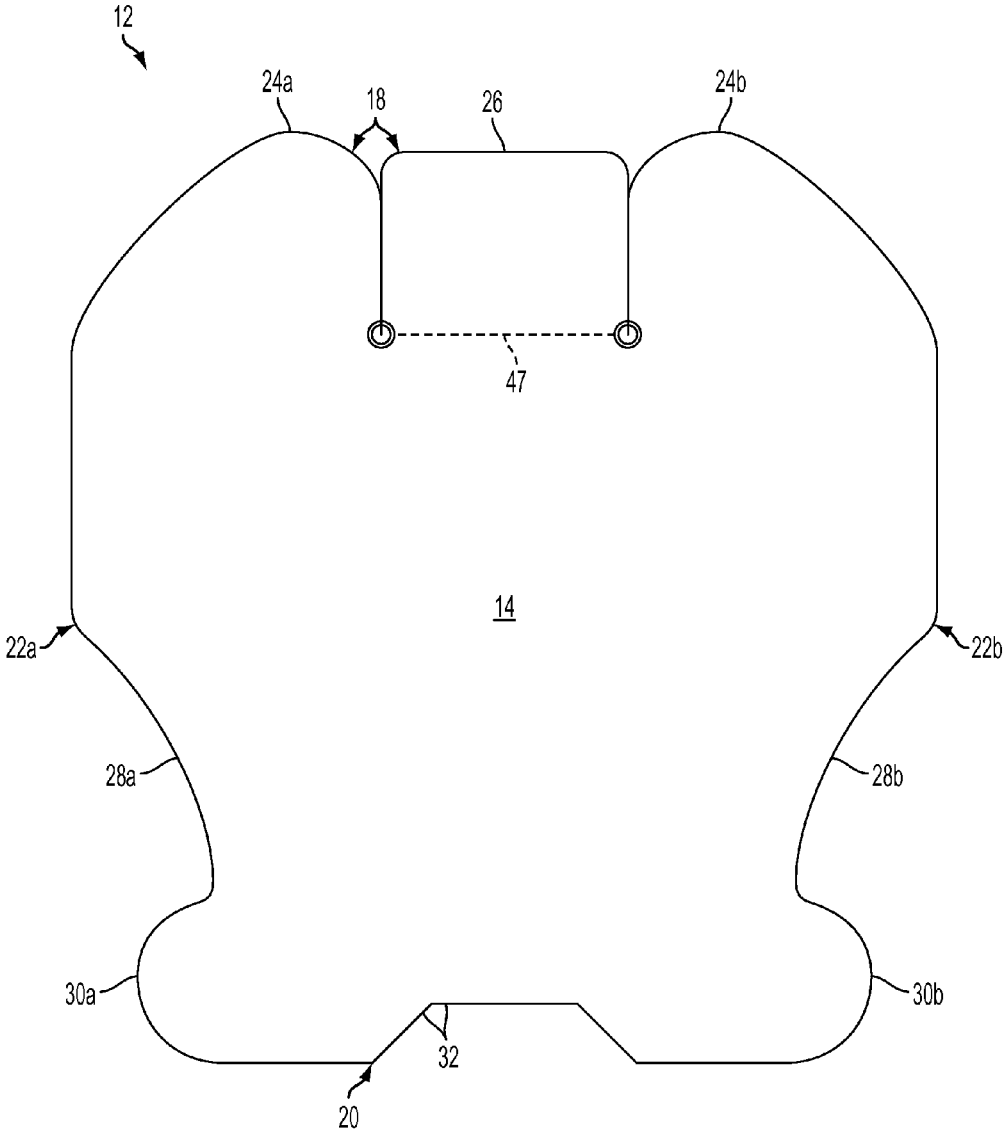
FIG. 1 is a top plan view of an embodiment of a surgical positioning system.
Figure 2:
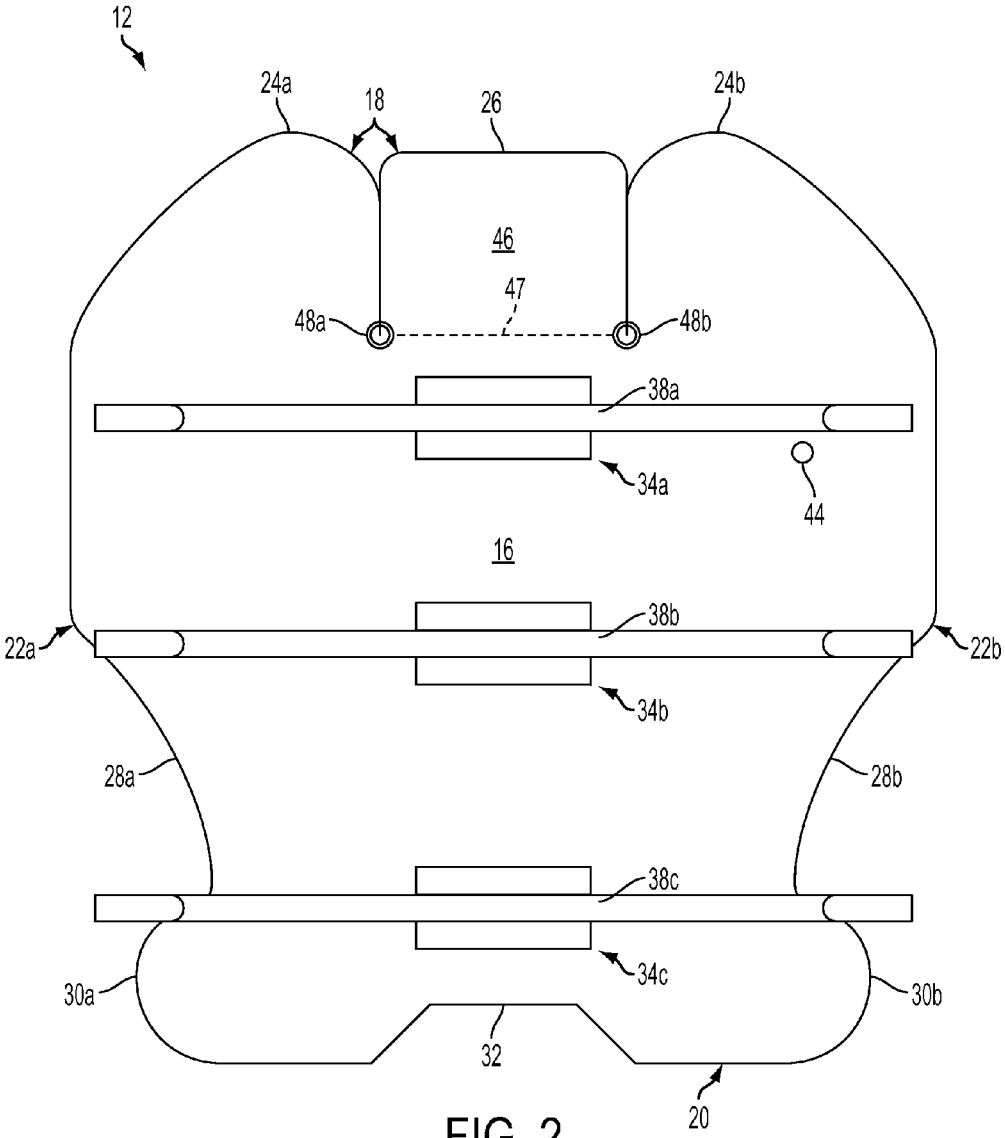
FIG. 2 is a bottom plan view of the embodiment of FIG. 1.

Referring to FIGS. 1 and 2, a surgical positioning system described herein includes a generally flat bag, or shell, 12 fabricated of flexible, air impermeable material. One exemplary material is "Rocheux Supreme" polyvinyl waterbed film, distributed by Rocheux International, Inc., Carson, Calif. The Rocheux material has desirable low temperature, tear, heat sealing and flexing qualities, as well as superior hydrostatic resistance which makes it particularly suitable for the present positioning system. It also has good resilience, returning quickly to its prior conformation, thereby holding the patient more securely. It is mildew-, bacteria-, puncture- and fire-resistant. Its physical properties can be as follows:

| | | |
|---|---|---|
| Thickness (inches) | 0.024, +5%, −0 | ASTM D-751 |
| Embossing | Plain | |
| Weight (oz./yd.$^2$) | 17.5 (min.) | ASTM D-751 |
| Volatility (% loss) | 1.5 (max) | ASTM D-1203-86, Method B |
| Elongation (%) | 350-360 (min) | ASTM D-882 |
| Elongate change after 14 days × 150° F. (%) | Less than 10 | ASTM D-882 |
| Breaking strength factor (psi) | 44 | ASTM D-882 |
| Tensile change after 14 days × 150° F. (%) | Less than 10 | ASTM D-882 |
| Graves tear (lbs.) | 5.6 (min) | ASTM D-1004 |
| Low temperature (° F.) | −20 (min) | ASTM D-1790 |
| Dimensional stability (%) | −5 (max) | ASTM D-1204 |
| Specific gravity | 1.21-1.23 | ASTM D-792 |
| Mildew resistance | Passes ATCC No. 6275 | California Bureau of Home Furnishings, Bulletin 128 |
| Bacteria resistance | Passes ATCC No. 6538, 4352 | California Bureau of Home Furnishings, Bulletin 128 |
| Hydraulic resistance (psi) | 75 | ASTM D-751 |
| Puncture resistance (lbs.) | 34.3 | California Bureau of Home Furnishings, Bulletin 100 |

In another preferred embodiment, the flexible impermeable material can comprise various other materials, such as a urethane material. Desirably, the shell material can be RF weldable and/or heat sealable in order to form an air tight seal between two portions of the shell material.

Figure 4:
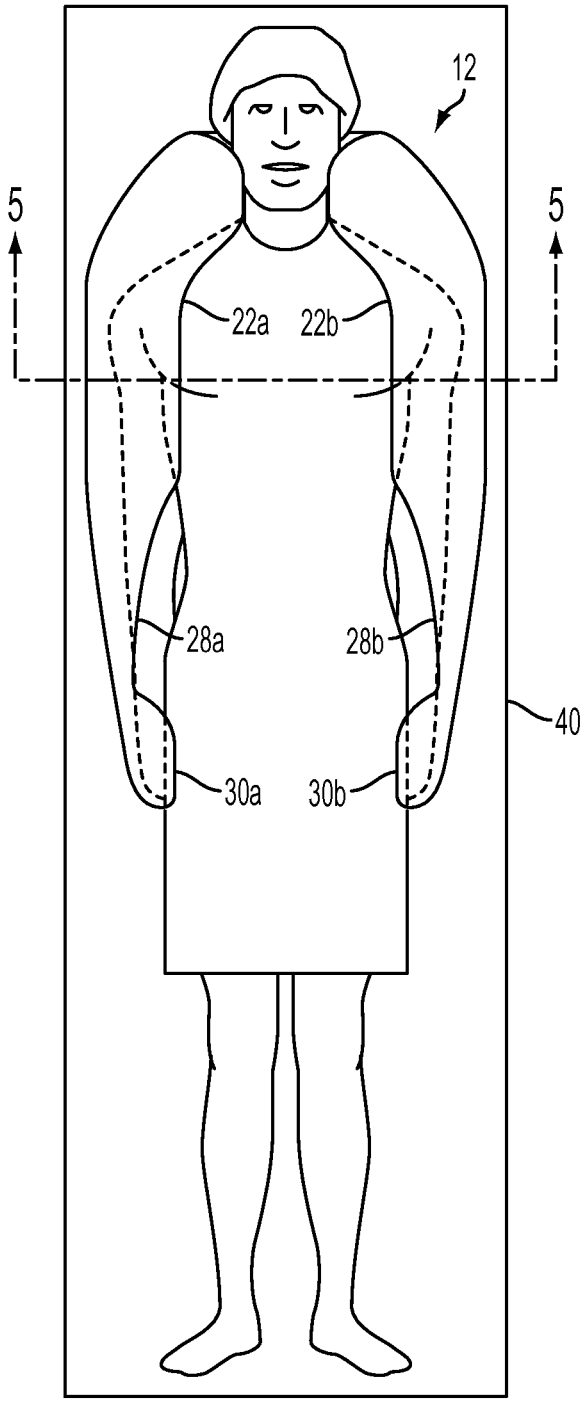
FIG. 4 is a top plan view of the FIG. 1 embodiment, patient and operating table.

The bag 12 can comprise top and bottom opposing walls 14, 16, which can be RF welded, heat sealed or otherwise joined together at their perimeters, such as at upper, lower and lateral edges 18, 20, 22, for strength and airtightness. The bag 12 can have any size and shape, such as for variously sized human patients and/or variously sized animal patients. In one embodiment for an adult human patient, the bag's width at its widest point can be about 42 inches, which exceeds the shoulder width of most patients, and the bag's length at its longest point is about 46 inches, which corresponds generally to the distance between the neck and upper thighs of an average height adult human patient. Thus, when the patient is placed in the supine position on the bag 12, as shown in FIG. 4, the lateral edges 22 can be folded up along the patient's neck, shoulders, arms, hips and upper thighs and packed snuggly against the patient's body to accommodate the natural contours thereof.

Referring again to the exemplary embodiment shown in FIGS. 1 and 2, the upper edge 18 includes two opposed shoulder edge portions 24*a*, 24*b*, and a pillow edge portion 26 located therebetween. Adjacent to the pillow edge portion 26, the shoulder edge portions 24*a*, 24*b* have a relatively tight radius of curvature, such as about 4⅜ inch, allowing the upper edge 18 to be folded upwardly adjacent either side of the patient's head and neck for support. As upper edge 18 extends laterally outwardly toward edges 22, the upper edge retains an arc-like curvature but the radius of curvature of shoulder edge portions 24*a*, 24*b* increases significantly, preferably to about 22 to 23 inches, to expand the width of the bag and allow the upper edge (when folded) to wrap around and at least partially overlie the patient's shoulders to support and immobilize the patient's upper body. The shoulder portions 24*a*, 24*b* of the upper edge 18 terminate where lateral edges 22*a*, 22*b* begin, defining the widest point of the bag.

Lateral edges 22*a*, 22*b* each define opposed cut-out portions 28*a*, 28*b*, and opposed projecting wrist supporting portions 30*a*, 30*b*. Wrist supporting portions 30*a*, 30*b* project outwardly to increase the width of the bag in the region proximate the lower edge 20. The width of the bag across the wrist supporting portions can be about 35 inches. The wrist supporting portions may be folded upwardly to provide lateral support for the patient's wrists and hands. They help secure the patient's wrists and hands against the side of the patient's body. The cut out portions 28*a*, 28*b* give the bag a tapered waist and low profile in the vicinity of the patient's arms so as to provide easy access to the patient's wrists and forearms for insertion of an IV, surgical access to the lower lateral abdomen, access for surgical instruments and other purposes.

The lower edge 20 preferably includes a central trapezoid-like cut out 32 to provide perineal access. The cut out 32 preferably conforms to perineal access cut outs sometimes used in operating room table designs to provide access for speculums, rectal instruments and the like.

As shown in FIG. 2, a plurality of strap patches 34*a*, 34*b*, 34*c* (three shown) are secured by heat sealing, radio frequency welding or otherwise to the bottom wall 16. The patches preferably are centered and spaced apart along the bag's longitudinal centerline/axis. Before the strap patches are attached to the bottom wall, an elongate fastener strap 38*a*, 38*b*, 38*c*, is attached, preferably by sewing or other fixed attachment method, to each patch 34*a*, 34*b*, 34*c*. FIG. 2 shows the ends of each strap doubled back on each other for purposes of illustration. The fastener straps 38*a*, 38*b*, 38*c* (FIGS. 7, 8) secure the bag 12 to an operating table 40 (FIG. 4) on which the bag and patient are supported. Each strap has a fastening means to fasten one end of the strap to the other or, when looped around an anchor, to itself to safely secure the bag 12 to the operating table and thereby prevent the bag from sliding relative to the operating table. The fastening means preferably includes Velcro® brand hook-and-loop fastening means or equivalent hook-and-loop fasteners, although adjustable buckle style, clip and other tie down straps will suffice. More specifically, each end of the straps may be looped around an operating table side rail, D-ring or other anchor structure on the table 40, and then secured back to itself using hook-and-loop fasteners or other fastening means. Alternatively, the two ends of each strap may be secured to one another along the underside of the operating table 40, depending on the design of the table.

In another embodiment, the straps can be formed of ballistic nylon. Also, instead of a Velcro®-type fastener, a buckle or other such fastening system (e.g., a D-Ring system, etc.) can be used to secure the ends of the straps to one another.

It will be appreciated that once the straps are secured to the operating table, the fixed attachment of the straps to the strap patches 34*a*, 34*b*, 34*c* (and effectively to the bag 12 as well), keep the bag from sliding laterally on the operating table as, for example, when the table is tilted laterally to place the patient in the Trendelenburg and Lateral Oblique position.

Before walls 14, 16 are joined together to form the enclosed bag 12, the bag is partially filled with a charge of beads 42 (FIG. 5), such as elastically deformable polymeric beads. As used herein, term "beads" means any small, generally globular, cylindrical, or otherwise rounded bodies. The beads preferably are made of expanded polymeric materials, such as polystyrene or polyvinyl chloride, because of their high mechanical strength, elastic deformability and low specific gravity. Beads 42 of expanded polystyrene are especially preferred. When the bag 12 is in the unevacuated condition, the beads 42 remain loose within the bag such that the upper, lower and lateral edges of the bag can be easily moved or folded up along the side of the patient's neck, shoulder, arms, hips and upper thighs to cradle and support the patient in the selected position. The bag preferably is configured to wrap around and overlie at least a portion of the patient's shoulders and upper chest, as shown in FIG. 4.

Figure 6:
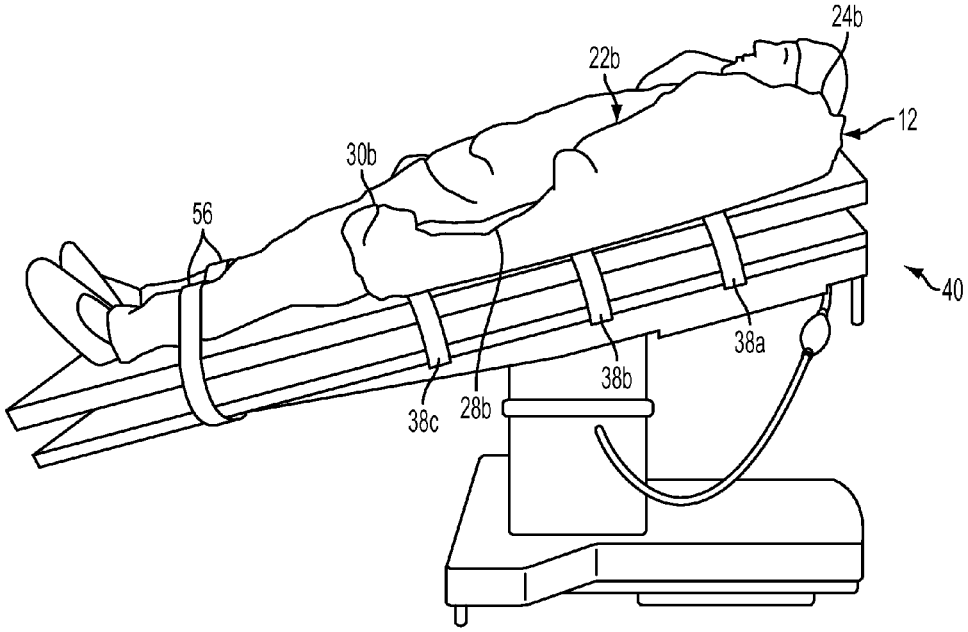
FIG. 6 is a perspective view of the FIG. 1 embodiment and showing a patient in the Reverse Trendelenburg position.
Figure 7:
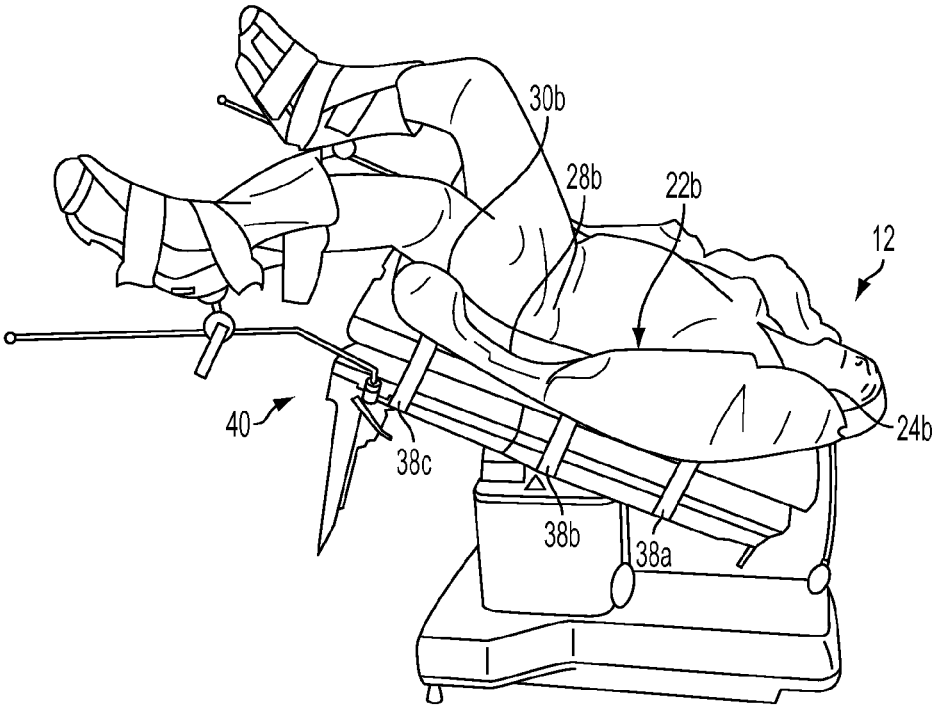
FIG. 7 is a perspective view of the FIG. 1 embodiment and showing a patient in the Trendelenburg as well as Lateral Oblique position.

The bottom wall 16 of the bag 12 is provided with a valve 44 (FIG. 2) which communicates with the interior of the bag for evacuating air therefrom. The valve 44 may be identical or similar to the one described in U.S. Pat. No. 5,906,205, the disclosure of which is herein incorporated by reference. The valve may have a male portion with a protruding valve stem and a plastic tube which connects the valve stem to the bottom wall 16 in an airtight manner. The valve also preferably includes a female portion that may be releasably placed over the male portion to depress the valve stem and open the valve to allow ingress or egress of air. When a source of vacuum is attached to the female portion, air is withdrawn from the interior of the bag. This causes the plastic beads 42 to be packed (or to congregate) into a tight configuration, conforming to the patient's body, as shown in FIGS. 6 and 7. When the female portion is removed from the male portion, the valve closes and no air can enter or exit the bag, thereby maintaining the conformity of the bag to the patient's body. When the patient is to be released, the female portion of the valve 44 (without the vacuum hose attached) is placed over the male portion. This opens the valve 44, thereby allowing air to enter the bag and loosening the configuration of the beads so that they reside in a more relaxed, fluid state. This allows the bag to flatten. It will be appreciated that a variety of conventional valves can be used to withdraw air from the bag, maintain the bag in an evacuated state and allow air to reenter the bag.

Figure 3:
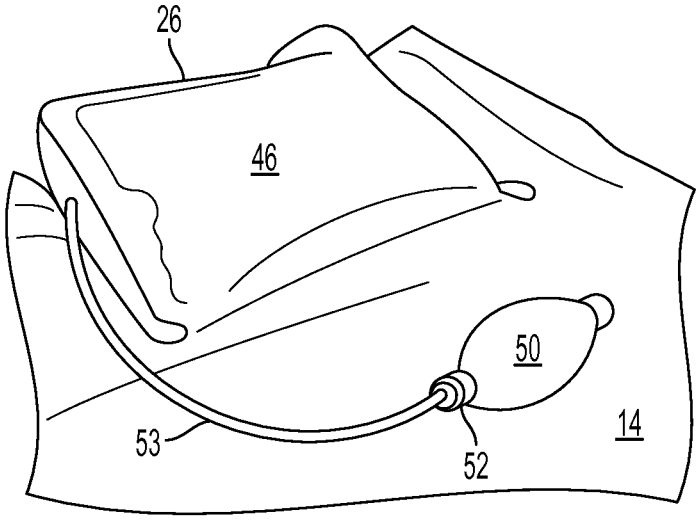
FIG. 3 is a perspective view of one portion of the FIG. 1 embodiment.

As shown in FIGS. 1, 2 and 3, the bag 12 can include an inflatable pillow 46 which is attached to a cut out portion in the bag located centrally along upper edge 18 between shoulder edge portions 24*a*, 24*b*. There is no fluid communication between the interiors of the bag 12 and pillow 46, each of which constitutes an air impermeable compartment of its own. The pillow has a width of about 12 inches in one embodiment of the present positioning system.

As shown best in FIG. 3, the pillow 46 can be connected to the bag 12 along a hinge line 47 extending between reinforcement grommets 48*a*, 48*b* (FIGS. 1, 2), which preferably is formed by joining the top and bottom walls 14, 16 by heat sealing, radio frequency welding or otherwise. The pillow is free to pivot about the hinge line 47 toward the top wall or bottom wall. The pillow 46 provides support for the patient's head and neck, and may be inflated more or less based on the desired position and orientation for the patient's neck/head during the particular procedure, patient's anatomy and other factors. The pillow may be flipped forward to rest on the top wall 14 to accommodate shorter patients.

The pillow preferably is made of the same material as the bag 12 itself. The pillow may be inflated by a number of conventional techniques, one of which is a hand held inflation bulb 50 (FIG. 3) having a release valve 52 attached to a length of plastic tubing 54 in air-type fluid communication with the interior of the pillow. It will be appreciated that the pillow 46 provides independently adjustable support for the patient's head and neck, allowing the surgeon or nurse to adjust the firmness of the support as well as the position and orientation of the patient's head and neck.

Figure 8:
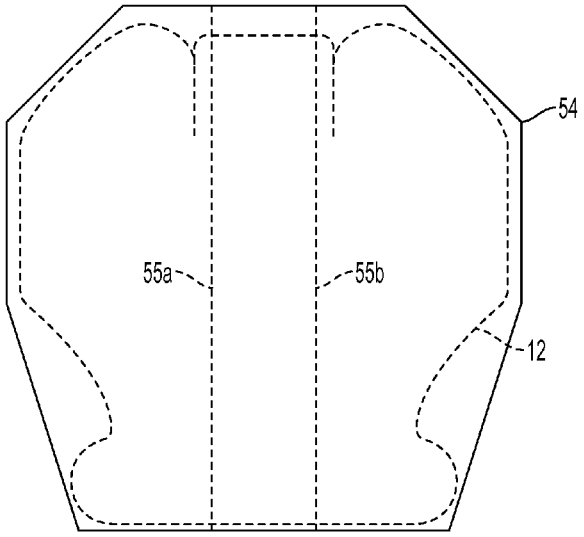
FIG. 8 is a top plan view of a slipcover used in conjunction with the FIG. 1 embodiment.

Referring to FIG. 8, the present positioning system may be provided with a disposable, waterproof slipcover 54 having a size and shape compatible with covering the top wall 14 of the bag 12, a top layer for fully covering the top wall 14 and bottom layer for partially covering the bottom wall 16. The slipcover 54 is provided with slits 54*a*, 54*b* that provide side pocket openings in the bottom layer of the slipcover, similar to a throw pillow cover. The openings or pockets allow the sides of the bag to be slipped into the slipcover side pockets such that the top layer of the slipcover covers the top surface of the bag.

Figure 9:
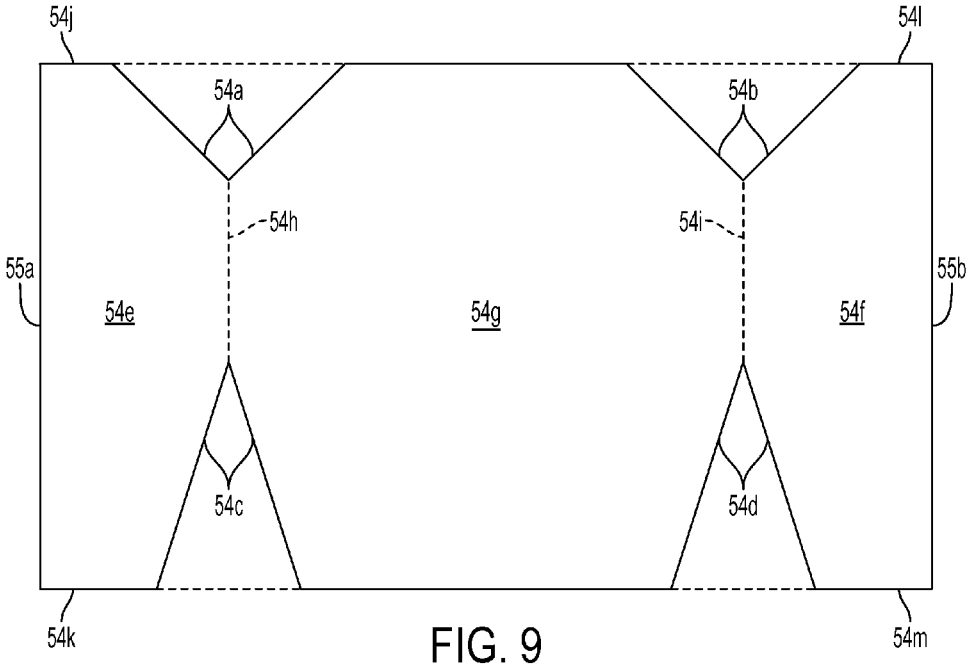
FIG. 9 is a top plan view of a slipcover material with a pattern indicated thereon.

With reference to FIG. 9, the slipcover is formed from a rectangular piece of fabric or material that is cut along cut lines 54*a*, 54*b*, 54*c*, 54*d*, defining side panels 54*e*, 54*f* and central panel 54*g*. Panels 54*e*, 54*f* are then folded underneath central panel 54*g* along fold lines 54*h*, 54*i*, and the edges 54*a*, edges 54*b*, edges 54*c*, and edges 54*d* are each preferably heat sealed together to create the design shown in FIG. 8. In this way, the panels 54*e*, 54*f* form a pair of laterally opposed, two-layer side pockets with respective portions of central panel 54*g*.

FIG. 4 is a top plan view showing an embodiment of a positioning system supporting the patient in a horizontal position on the operating table 40 during surgery. Air has been evacuated from the bag 12. The positioning system 40 covers the patient's shoulders and provides lateral stabilizing support for the patient's head and neck. Lateral support also is provided for the patient's upper arms, hips and upper thighs, while still providing easy access to the patient's forearms, wrist, and lower lateral abdomen. The pillow 46 supports and orients the back of the patient's head and neck.

Figure 5:
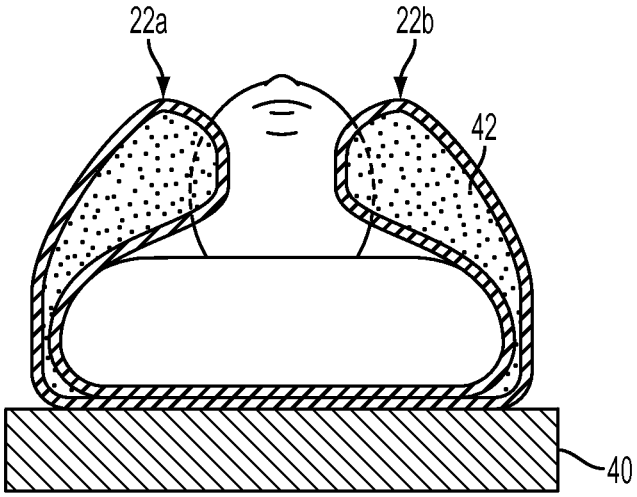
FIG. 5 is a sectional view taken along line 5-5 in FIG. 4.

FIG. 5 is a transverse sectional view of an exemplary positioning system, also in the evacuated condition, taken across the patient's shoulders and upper chest. The positioning system envelopes the patient's upper arms and a portion of the patient's upper chest while providing malleable, comfortable underlying support for the patient's posterior. The positioning system readily conforms to the patient's anatomy.

FIG. 6 is a side elevation view showing an evacuated bag 12, operating table 40 and supine patient in a Reverse Trendelenburg position, with the patient's head elevated above the feet. The patient's lower legs typically are secured to the table by one or more straps. The bag, which conforms closely to the patient's anatomy, cooperates with the straps to comfortably immobilize the patient and resist the force of gravity urging the patient to slide downwardly feet first. A foot board optionally may be placed adjacent the patient's feet. The positioning system partially envelops the patient and creates a friction contact with the patient that must be overcome before the patient may slide relative to the bag and operating table (which are effectively locked together by the straps 38*a*, 38*b*, 38*c*). The conformity of the bag to the contours of the patient's body helps keep the patient from sliding. The wrist supporting portions 30*a*, 30*b*, when folded up, support the patient's hands and wrists and also help create a narrow channel in the area of the patient's hips, which is typically smaller than the width of the patient's shoulders, thereby resisting any tendency of the patient to slide down the inclined plane formed by the operating table.

FIG. 7 is a side elevation view showing an evacuated bag 12, operating table 40 and supine patient in a Steep Trendelenburg position, with the patient's feet elevated above her head, and also in a Lateral Oblique position, with the patient tilted laterally to one side. FIG. 7 also depicts the patient with her legs slightly bent and feet spaced apart for certain types of gynecological, laparoscopic, abdominal and urological procedures. It will be apparent that with the patient so positioned the tendency of gravity is to cause the patient to slide downwardly head first on the table and toward one side of the table.

The positioning system envelops the patient's shoulders and a portion of her chest, creating a narrow channel around the patient's neck and shoulders to resist the tendency of the patient to slide either laterally or longitudinally on the inclined plane formed by the operating table. The system provides substantial bulk and mass in the area of the patient's shoulders to help hold the patient in place. The system's conformity to the patient's anatomy (lower back, spine, shoulder blades, etc.) contributes to hold the patient in place.

In using the surgical positioning system, the bag 12 is centered on the operating table 40, with the pillow 46 toward the head of the operating table, and securely fastened to the table using the fastening straps 38*a*, 38*b*, 38*c*. The straps may be secured to the side rails of the operating table. The bag is then smoothed out so that the internal beads 42 inside are evenly distributed. The disposable waterproof slipcover 54 is then placed over the bag 12 and tucked underneath.

The patient is then placed in the supine position on the bag with the neck and head resting on the pillow 46. In the case of smaller or shorter patients, the pillow can be folded forward before the patient is placed in position. The inflation bulb 50 is then used to inflate the pillow as much as necessary to support and position the patient's head/neck, typically in a neutral position for most surgeries.

The lateral sides of the bag are then folded upwardly to engage the sides, shoulders and upper arms, forearms and wrists of the patient. The lateral and superior sides are snugly packed against the patient to accommodate the natural contours thereof and provide a generally U-shaped cradle for the patient. The top of the bag conforms to the patient's posterior. While holding the patient and bag in the desired position, air is evacuated from the interior of the bag 12. Specifically, the female portion of the evacuation valve 44 is attached to the male portion and a vacuum source is connected to the end of the female portion to evacuate air from the interior of the bag. Evacuation is continued until the bag is firm to provide contoured support for the patient. When the desired level of support is achieved, the female portion is detached from the male portion and the vacuum source is detached from the female portion. The bag retains its conforming shape. It will be appreciated that many types of known valve/hose constructions can be used to create and release the vacuum.

Once the patient is secured, the operating table 40 may be inclined to place the patient in the Steep Trendelenburg, Reverse Trendelenburg, Oblique Lateral or other inclined position for surgery. The positioning system uses different techniques to immobilize the patient in a comfortable manner while avoiding the application of significant local pressure to any specific region. The system spreads the cradling/supporting force over a relatively wide surface area of the patient's anatomy and yet provides easy access to a large surface area of the patient's anatomy, including the patient's forearms and lower lateral abdomen. Significantly, the system retains the patient in place by engaging a wide surface area of the patient in a way that eliminates pressure points. The bag's low profile in the vicinity of the patient's forearms also allows surgical instruments to swing lower along the side of the patient and allows the tips of medical instruments in the abdomen to reach the inner aspect of the anterior abdominal wall with less interference from the side restraints of conventional systems. Yet, the positioning system maintains contact with a sizable surface area of the patient's anatomy, including the patient's shoulders, upper arms, forearms, hands, hips and thighs. Such surface contact provides a friction surface and contour fit to resist the tendency of the patient to slip or slide longitudinally relative to the bag.

The bag's overall design also provides protuberances or abutments that serve as longitudinal obstructions for portions of the patient's anatomy. These obstructions resist the gravity influenced tendency of the patient to slide or slip on the inclined operating table. For example, as shown in FIG. 7, the shoulder edge portions of the bag provide a longitudinal and lateral barrier for the shoulders of a patient subject to a gravitational force urging the patient to slide head first or laterally off the operating table. The wrist supporting portions restrain the patient's hands and arms from moving laterally relative to the operating table. As shown in FIG. 6, the wrist supporting portions/projections, when folded up, provide a longitudinal and lateral obstruction for the arms of a patient subject to a gravitational force urging the patient to slide feet first or laterally off the operating table. In this case, the bag 12 also cooperates with leg straps 56, which typically are used to secure the patient's lower legs to the operating table.

The bag also is designed to create narrow channels to resist sliding movement of the patient relative to the bag and the operating table. More specifically, as shown best in FIGS. 4 and 7, the bag defines a relatively narrow channel at the end where the patient's head is placed. The patient's shoulders, chest, and hips have a width dimension that exceeds the width of the head/neck channel associated with the pillow 46. Thus, when the patient is inclined head first, the narrow channel defined at the head end of the bag prevents the wider portions of the patient's anatomy from sliding longitudinally through the channel. The channel effect and shoulder wrap secures the patient even in the steepest Trendelenburg position. In addition, the wrist supporting portions 30*a*, 30*b* also define a narrowing channel in the vicinity of the patient's hands and upper thighs. For a patient to slide feet first on the operating table relative to the bag, the patient's hips and shoulders, which are wider than the wrist channel, would have to slide through the narrow channel.

Figure 10:
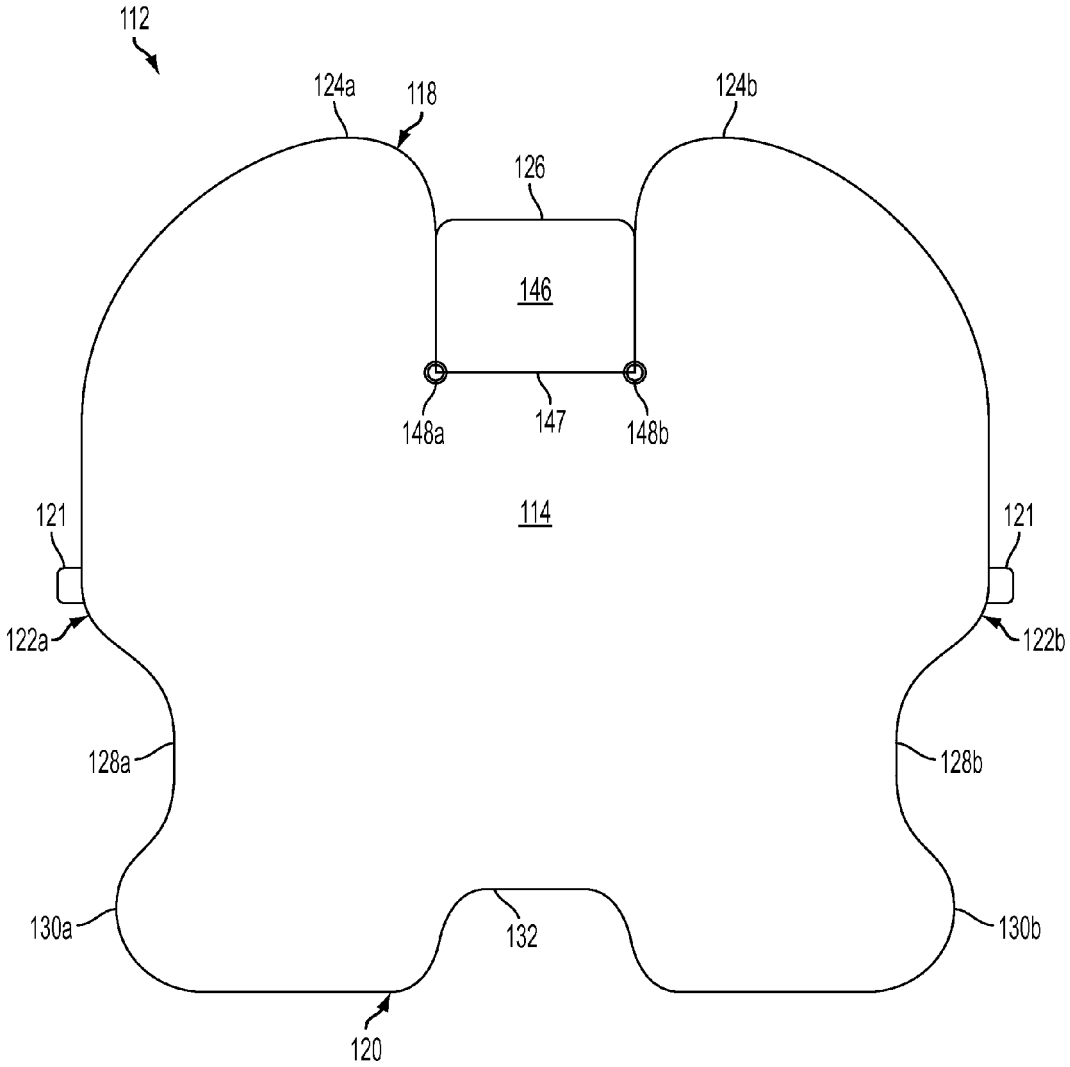
FIG. 10 is a top plan view of an embodiment of a surgical positioning system.
Figure 11:
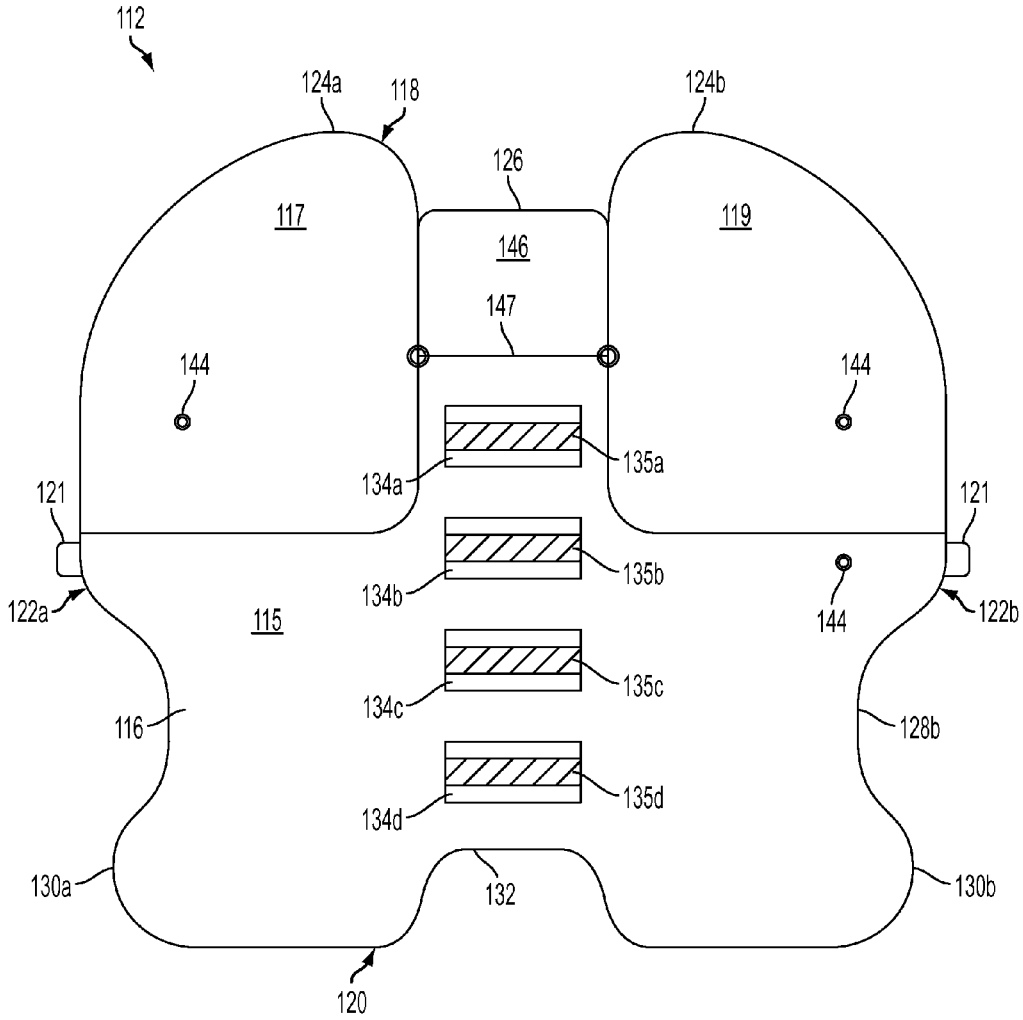
FIG. 11 is a bottom plan view of the embodiment of FIG. 10.

FIGS. 10 and 11 illustrate another embodiment of a surgical positioning system that has multiple chambers. For convenience, elements that are structurally and/or functionally similar to those described above in other embodiments are designed with like reference numbers. Thus, for example, surgical positioning system 112 comprises top and bottom opposing walls 114, 116 that are generally as described above with respect to other embodiments. Top and bottom walls 114, 116 are joined together at their upper, lower and lateral edges 118, 120, 122 for strength and airtightness. As will be understood by the following description, many of the features of the multi-chambered positioning devices described below are common and/or similar to those of the single-chambered positioning devices described above. Moreover, as will be understood by one of ordinary skill in the art, many features of these devices can be used interchangeably between the multi-chambered and single-chambered devices.

Surgical positioning system 112 includes multiple chambers filled with beads 42 to further facilitate positioning and securing the patient using the positioning system. As shown in FIG. 11, which is a bottom view of surgical positioning system 112, a plurality of chambers are provided in different areas of surgical positioning system 112.

Figure 13:
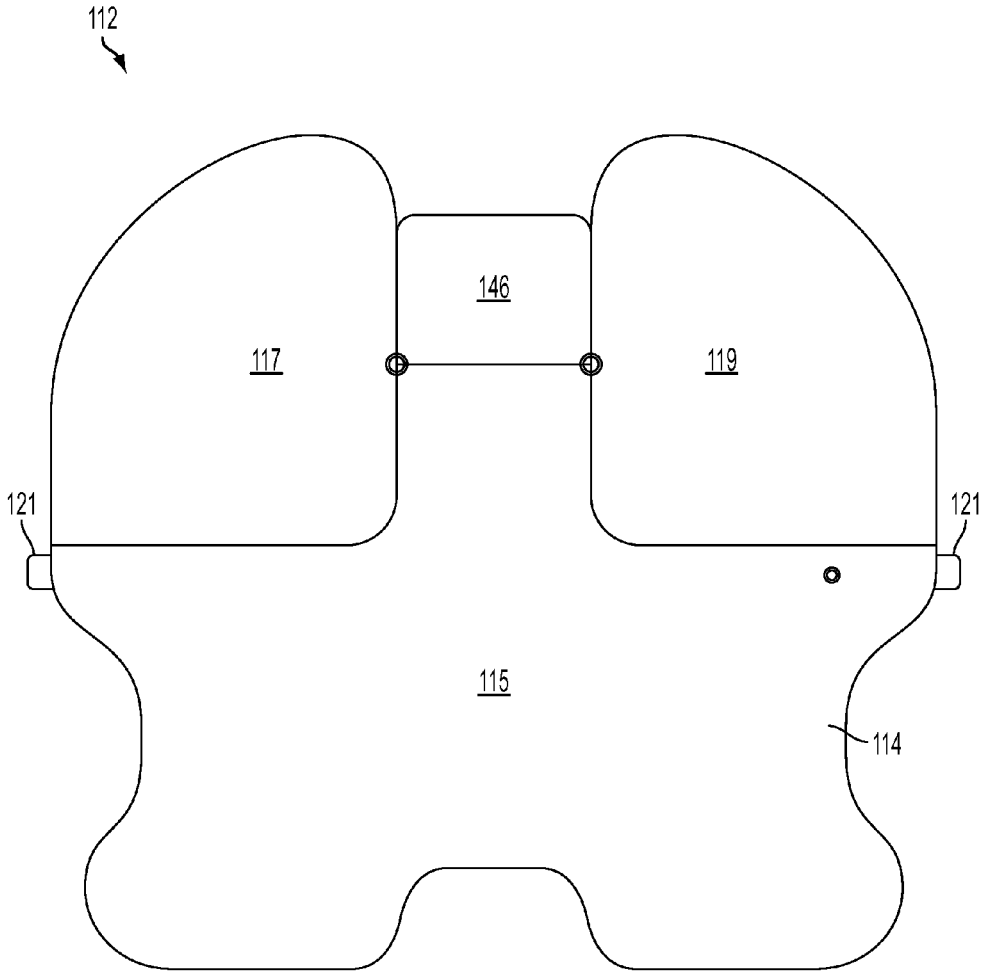
FIG. 13 is a top plan view of an embodiment of a surgical positioning system.

Such chambers can be formed in a variety of manners. For example, in the embodiment shown in FIGS. 10 and 11, the plurality of chambers are formed by sealing portions of bottom walls 116 to top wall 114 (e.g., by heat sealing, radio frequency welding, etc.). By forming the various chambers in this manner, the chambers may only visible from the bottom of the surgical positioning system 112. In other embodiments, however, the various chambers can be formed so that they are visible from both the top and bottom sides of the positioning system 112. For example, FIG. 13 illustrates an embodiment where the different chambers 115, 117, 119 are formed by sealing top wall 114 and bottom wall 116 so that the chambers are visible from the top side of the positioning system 112.

As shown in FIG. 11, a first main chamber 115 is provided in a central and lower area of the surgical positioning system 112. In addition to main chamber 115, secondary chambers 117, 119 are preferably positioned at locations that allow for the creation of greater fixation forces between adjacent chambers to further restrict the movement of the patient relative to the positioning system 112.

By forming a plurality of adjacent chambers of beads 42, surgical positioning system 112 can be formed with greater rigidity. As described above, in single chamber systems, the beads form a sold mass when air is removed from the chamber. As the solid mass forms, the beads conform to the patient to immobilize the patient in a desired position. In contrast, by forming multiple solid masses by separately evacuating adjacent chambers, not only do each of the solid masses conform to the patient to immobilize the patient in the desired position, but adjacent solid masses also interlock with one another to increase the rigidity of the system.

For example, by evacuating main chamber 115 first, main chamber 115 forms a solid mass that at least partially conforms to the patient. When the solid mass is formed, edges and surfaces of main chamber 115 form irregular surfaces (e.g., bends, folds, crinkles). As air is evacuated from secondary chambers 117, 119, each of those chambers also forms a solid mass that at least partially conforms to the patient. In addition, as each of those solid masses is formed, edges and surfaces of secondary chambers 117, 119 also form irregular surfaces (e.g., bends, folds, crinkles).

As seen in FIG. 11, main chamber 115 has various edges and surfaces that are adjacent to the edges and surfaces of at least a portion of one of secondary chambers 117, 119. After main chamber 115 and secondary chambers 117, 119 are evacuated, those adjacent edges and surfaces of main chamber 115 and secondary chambers 117, 119 are in contact with one another. Because of the irregularities of the surfaces of each of the evacuated chambers, the surfaces of secondary chambers 117, 119 at least partially interlock and/or form a frictional fit with the surface of main chamber 115. Such contact between the adjacent surfaces further increases the rigidity of the positioning system 112 by increasing friction between the adjacent surfaces, thereby restricting relative movement of adjacent chambers. In this manner, the surgical positioning system can be used to further immobilize the patient in anticipation of a surgical procedure.

Secondary chambers can be positioned on positioning system 112 where greater rigidity and strength can be particularly useful, such as at a portion on positioning system 112 where the most pressure is exerted by the patient. For example, when a patient is in the Trendelenburg position, this can be at an upper portion (e.g., shoulder region) of the positioning system 112, where a large portion of the patient's weight is directed.

Figure 12A:
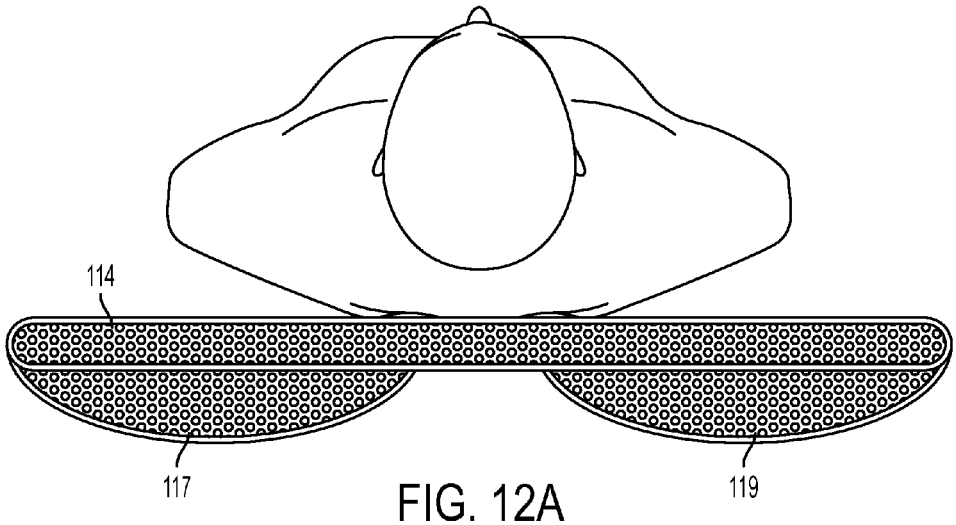
FIG. 12A is a partial cross-sectional end view of a surgical positioning system.
Figure 12B:
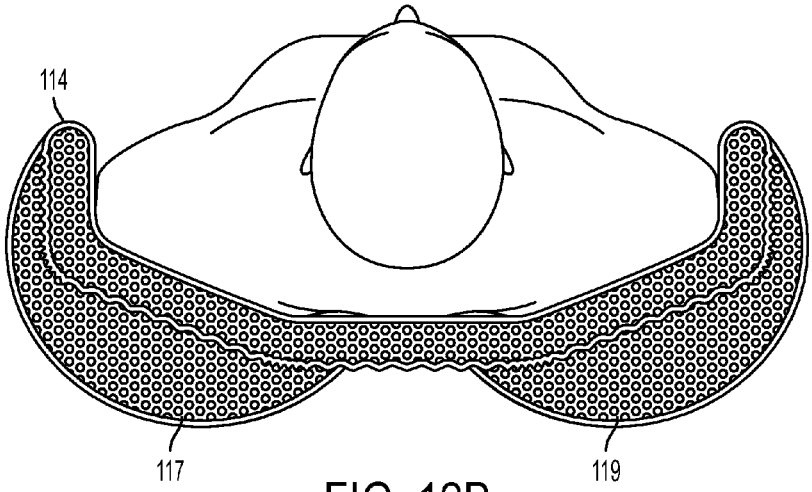
FIG. 12B is a partial cross-sectional end view of the surgical positioning system of FIG. 12A, shown with chambers in an evacuated state.

As shown in FIG. 11, secondary chambers 117, 119 can be provided adjacent the upper portions of main chamber 115. FIGS. 12A and 12B illustrate end views of main chamber 115 and secondary chambers 117, 119. FIGS. 12A and 12B are partial cross-sectional views that show chambers shown in cross-section for clarity. FIG. 12A illustrates the chambers in an unevacuated state, while FIG. 12B illustrates the chambers in an evacuated state. As shown in FIG. 12B, when the adjacent chambers are evacuated, the irregularities of the surfaces of each of secondary chambers 117, 119 at least partially interlock and/or form a frictional fit with the surface of main chamber 115. As seen in FIG. 12B, this contact increases the rigidity of the positioning system 112 and restricting relative movement of adjacent chambers longitudinally (i.e., along the length of the patient) as well as laterally (i.e., towards the sides of the patient). Thus, the surgical positioning system can further immobilize the patient by providing longitudinal and lateral support by the layered configuration shown in FIGS. 12A and 12.

Thus, if the patient is in a Trendelenburg position, with his or her feet above the head, the downward force exerted by the patient can be at least partially countered by the frictional forces between adjacent edges and surfaces of the main chamber 115 and secondary chambers 117, 119. As each of the chambers 115, 117, 119 conform to the patient, surfaces of the chambers contact and engage with surfaces of at least one adjacent chamber to restrict relative movement between adjacent chambers.

Although the embodiment of FIGS. 12A and 12B illustrates secondary chambers 117, 119 on top of main chamber 115, it should be understood that secondary chambers 117, 119 could be positioned below main chamber 115. In both embodiments, however, a surface of the secondary chambers 117, 119 can engage a surface of main chamber 115 to restrict relative movement between the contacting (i.e., frictionally engaged) surfaces of the chambers.

Multi-chambered positioning systems can be particularly useful for use with bariatric patients. Bariatric patients are those patients that exceed the physical size, shape, width, and/or weight of an average patient. It is not uncommon for bariatric patients to weigh in excess of 300 pounds and, in some cases, over 400 pounds. Due to the increased forces exerted by a bariatric patient on the support system, the additional rigidity and support provided by the friction forces between adjacent chambers can be particularly helpful to immobilize and position the patient in the manners described above.

In bariatric applications, the positioning system's preferred width at its widest point can be significantly larger than in other applications. Thus for example, instead of about 42 inches, the width of the positioning system can be about 54 inches which exceeds the shoulder width of most bariatric patients. The positioning system's preferred length can also be longer, with its longest point about 51 inches. Thus, when the bariatric patient is placed in the supine position on the positioning system 112, the lateral edges 122 can be folded up along the patient's neck, shoulders, arms, hips and upper thighs and packed snuggly against the bariatric patient's body to accommodate the natural contours thereof.

Referring again to FIG. 10, the upper edge 118 includes two opposed shoulder edge portions 124*a*, 124*b*, and a pillow edge portion 126 located therebetween. As shown in FIG. 11, opposing shoulder edge portions 124*a* and 124*b* are formed by respective secondary chambers 117, 119. As in other embodiments, adjacent to the pillow edge portion 126, the shoulder edge portions 124*a*, 124*b* can extend upward and away from pillow edge portion 126 a distance greater than in other embodiments. For example, in some embodiments, the shoulder edge portions 124*a*, 124*b* can extend at least 4 inches, and preferably 5 inches or more, from the pillow edge portion 126.

As in other embodiments, lateral edges 122*a*, 122*b* each define opposed cut-out portions 128*a*, 128*b*, and opposed projecting wrist supporting portions 130*a*, 130*b*. In the example, shown in FIG. 11, secondary chambers do not extend into cut-out portions 128*a*, 128*b*; however, it should be understood that different shapes and configuration of secondary chambers are possible.

As shown in FIG. 11, a plurality of strap patches 134*a*, 134*b*, 134*c*, and 134*d* can be secured by any known manner, including, for example, heat sealing, radio frequency welding or otherwise to the bottom wall 116. As in other embodiments, the patches preferably are centered and spaced apart along the positioning system's longitudinal centerline/axis. Fastener straps such as those shown in FIGS. 7 and 8 can be used to secure the positioning system 112 to an operating table 40 (e.g., FIG. 4) on which the positioning system and patient are supported. Straps can be secured to a respective Velcro® brand hook-and-loop fastener portion 135*a*, 135*b*, 135*c*, and 135*d* of the strap patches. Alternatively, strap patches can comprise loop portions through which straps can be positioned to secure the positioning system to the table.

It will be appreciated that once the straps are secured to the operating table, the fixed attachment of the straps to the strap patches 134*a*, 134*b*, 134*c* (and effectively to the positioning system 112 as well), keep the positioning system from sliding laterally or longitudinally on the operating table as, for example, when the table is tilted laterally while the patient in the Trendelenburg and other positions.

Additional strap and/or fastening systems can be used to further secure the patient and/or the positioning system to the table. For example, as shown in FIGS. 10 and 11, strap-receiving members 121 can be positioned at the lateral edges 122*a*, 122*b* of the positioning system 112. Strap-receiving members 121 can comprise loops or other such devices that are capable of receiving and securing a strap at the lateral edges 122*a*, 122*b*. Strap-receiving members 121 can be secured to the lateral edges 122*a*, 122*b* in any known manner, such as the heat sealing, radio frequency welding, stitching, etc. Once the positioning system 112 is evacuated so that it conforms to the patient, straps can be passed through the strap-receiving members (e.g., loops), around the patient, and to at least a portion of the operating table to further secure the patient and positioning system 112 to the operating table. Such straps can be particularly helpful when the operating table is tilted laterally as such straps can further restrict lateral movement of positioning system 112 relative to the operating table.

The strap-receiving members 121 shown in FIGS. 10 and 11 are shown positioned at lateral edges of a main chamber; however, it should be understood that such strap-receiving members 121 can be positioned at other locations on the positioning system 112, including for example, at other points along the lateral edge of the main chamber and at points along other surfaces on the main chamber (e.g., on the top and/or bottom walls). Such strap-receiving members can also be positioned on the secondary chambers 117, 119 and/or adjacent those chambers if desired.

Positioning system 112 preferably is configured to wrap around and overlie at least a portion of the patient's shoulders and upper chest, as described in other embodiments and as shown, for example, in FIG. 4. The straps that extend from strap-receiving members 121 and around the patient can also reduce the width of the positioning system 112 in its evacuated configuration. Thus, for example, if the positioning system 112 has portions that "wing" or extend laterally over the edges of the operating table, the straps can pull those portions of the positioning system 112 inward (i.e., towards the patient), thereby eliminating or reducing the amount that the positioning system 112 extends off the operating table. This can be particular useful when using a larger positioning system with bariatric patients because such positioning systems (and the patients themselves) can be wider than the operating table.

The straps can be secured around or coupled to any available portion of the operating table. For example, the straps can be secured to a side rail or, in other embodiments, can extend around the bottom of the table and be secured to another portion of the table or to itself.

In the exemplary embodiments that include multiple chambers described above, each of the various chambers can be evacuated independently of the evacuation of other chambers. Thus, as described above, main chamber 115 can be evacuated before secondary chambers 117, 119 are sequentially or concurrently evacuated. To permit independent evacuation, each of the chambers 115, 117, 119 can have a valve 144 that communicates with the interiors of the chambers 115, 117, 119 for evacuating air therefrom. Various possible valves are described in more detail above.

Figure 14:
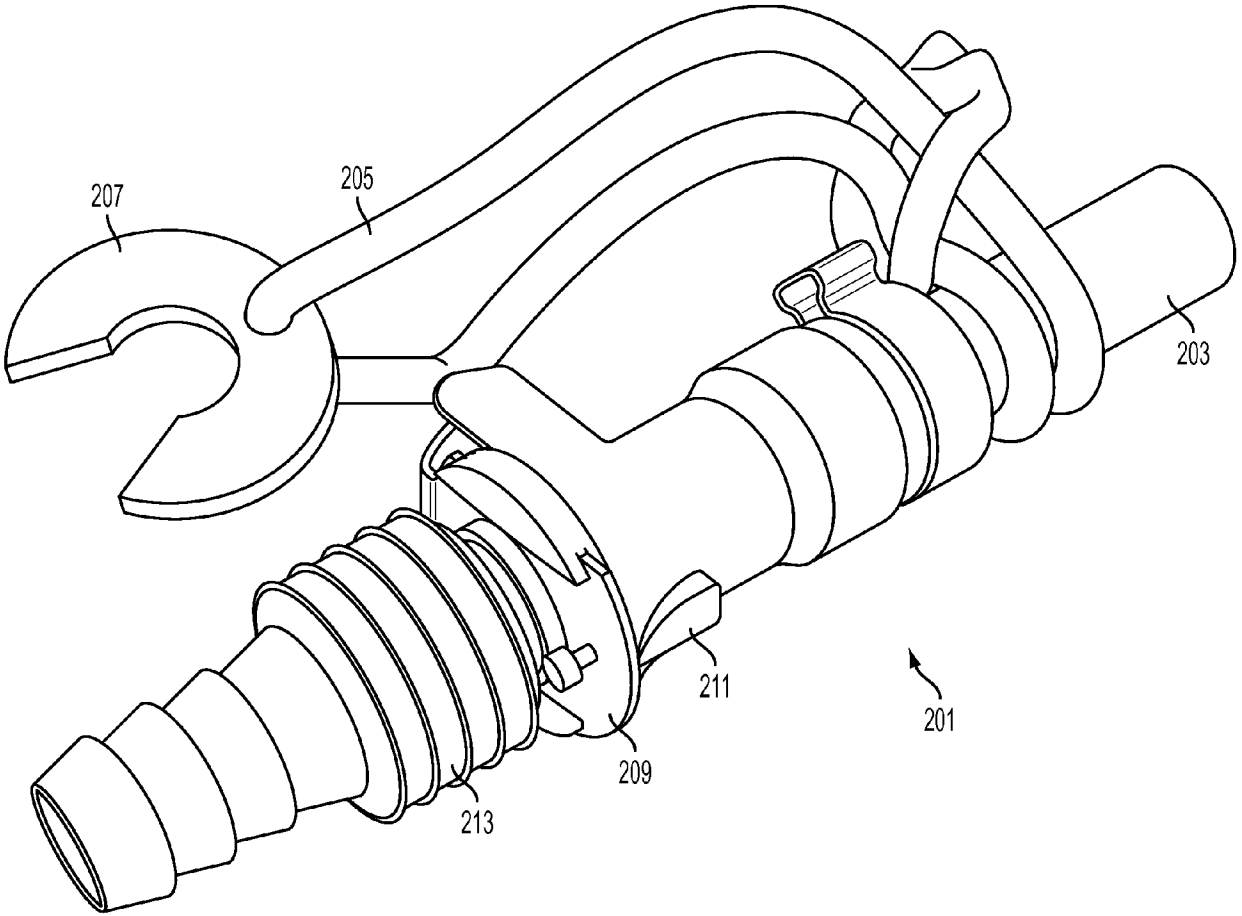
FIG. 14 is a perspective view of a locking mechanism for use with a surgical positioning system, showing the mechanism in an unlocked position.
Figure 15:
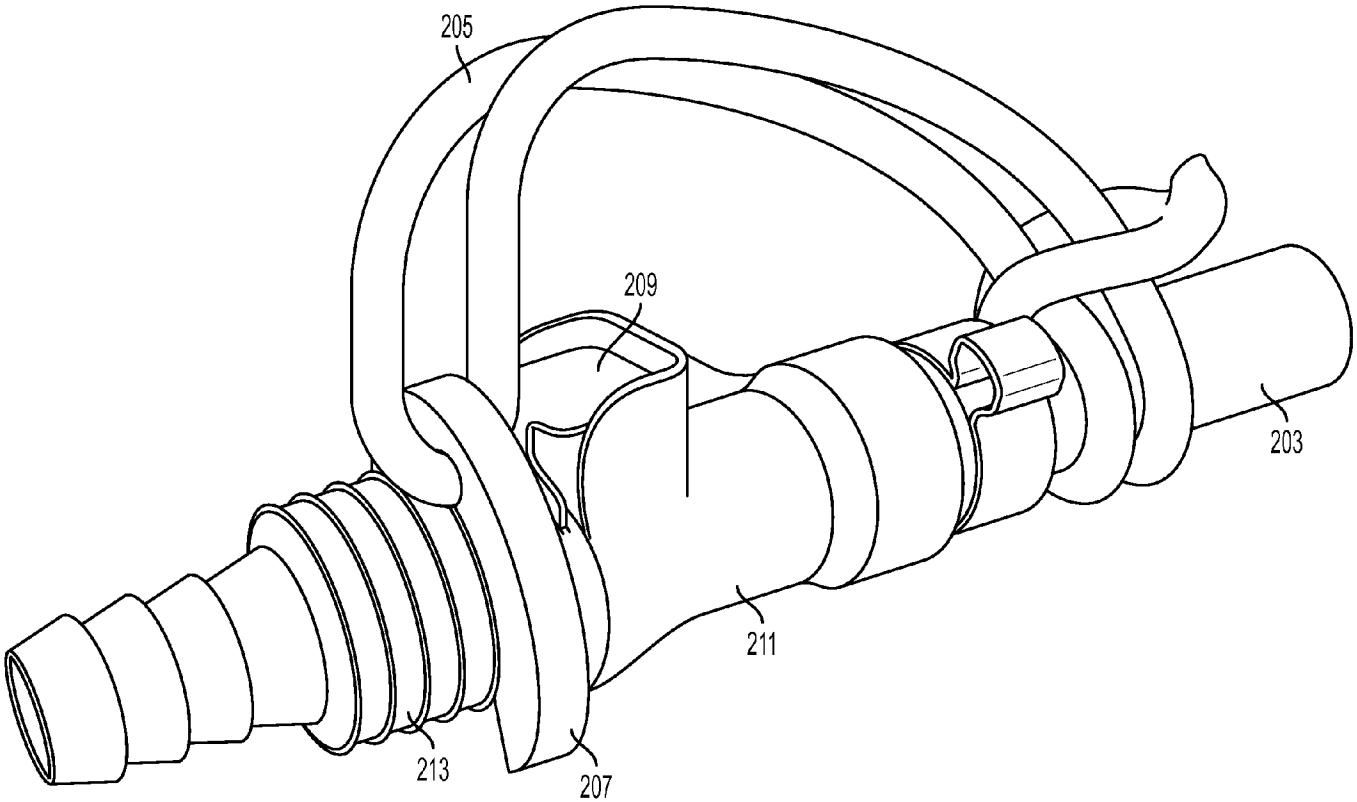
FIG. 15 is a perspective view of a locking mechanism for use with a surgical positioning system, showing the mechanism in a locked position.

A valve lock can also be provided to lock the valve after evacuation to prevent an unintentional and/or accidentally release of the negative pressure applied to the positioning system during operation. FIGS. 14 and 15 illustrate an exemplary valve system 201 that can be moved between an open and a closed position to allow or restrict, respectively, the flow of air into and out of the chambers associated with that valve system 201.

FIG. 14 illustrates a valve locking system that comprises a valve stem 203, a main portion 211, and a moveable member 213 coupled to the main portion 211. Moveable member 213 can be moved inward to open the valve system 201 and allow the ingress and egress of air from the chamber associated with that valve system 201. An intermediate member 209 can be positioned between main portion 211 and moveable member 213, with the intermediate member 209 forming a slot into which a lock member 207 can be received. Lock member 207 can be formed in a C-shape so that it can be received within the slot of the intermediate member 209.

As shown in FIG. 15, when lock member 207 is inserted into the slot formed between main portion 211 and moveable member 213, moveable member 213 cannot be moved inward to the open position. Thus, lock member 207 can secure the valve system 201 in a closed position and the chance of valve system 201 being accidentally opened during a surgical procedure (or at any other undesired time) can be significantly reduced.

At least one port can be provided in one or more of the top and bottom walls 114, 116 to allow for the addition of beads to the positioning system 112. Because of the negative pressures applied to the beads, over time, the beads can deteriorate and lose some functionality. Accordingly, the port allows access to the internal chamber(s) of the system so that additional beads can be added to system. Of course, the port can also allow for the removal or exchange of beads within the positioning system. The port can comprise an opening that has a cover (e.g., a round cap) or removable member capable of allowing access to the opening. Such ports can also be schematically depicted by a square hinged member positioned along any surface of one or more chambers. Port(s) are preferably positioned on the bottom wall 116 of the positioning system so that the port(s) are not located on the side of the positioning system that contacts the patient.

Figure 16:
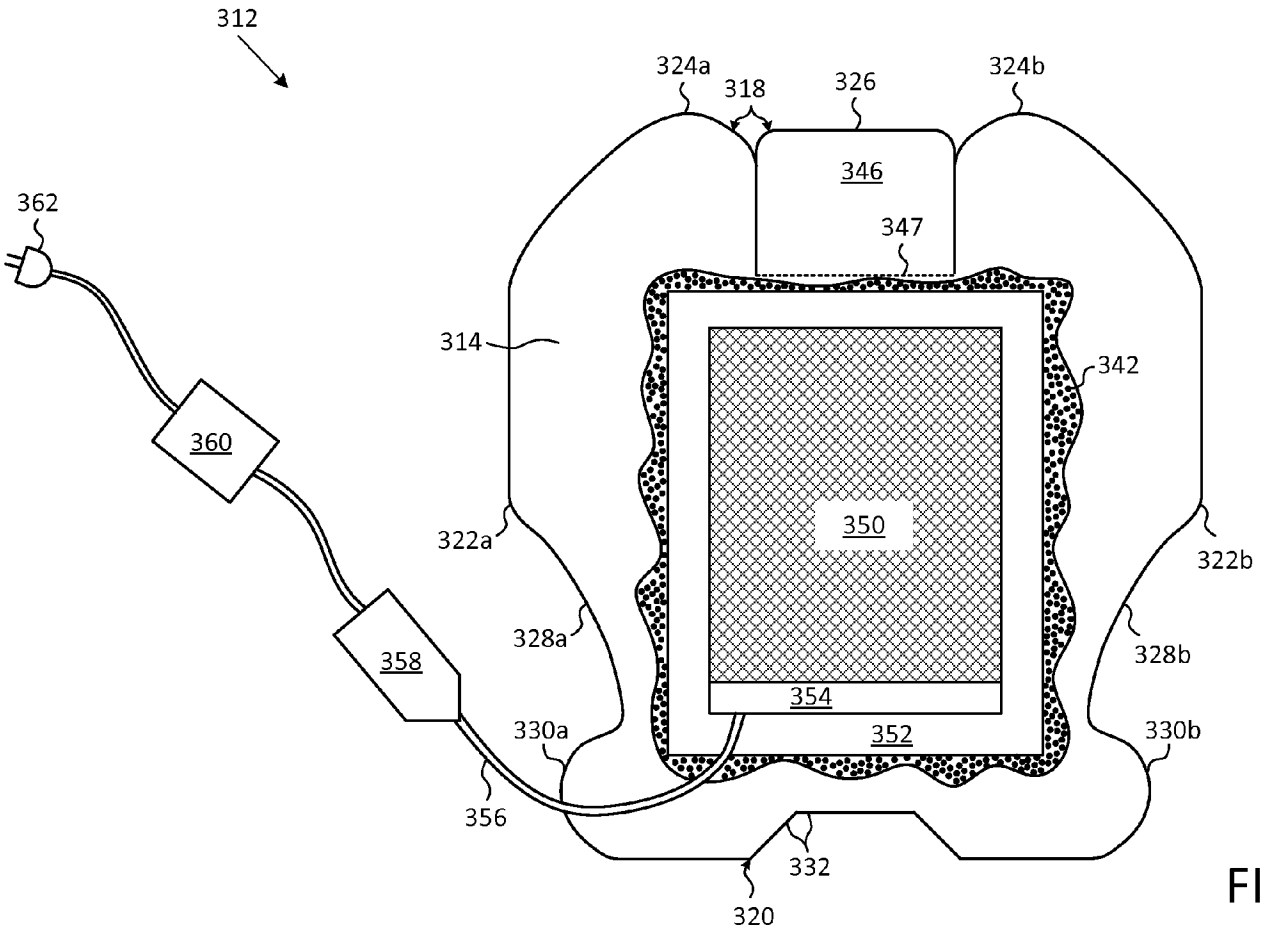
FIG. 16 is a plan view of another embodiment of a surgical positioning system that includes an electrical warming apparatus.
Figure 17:
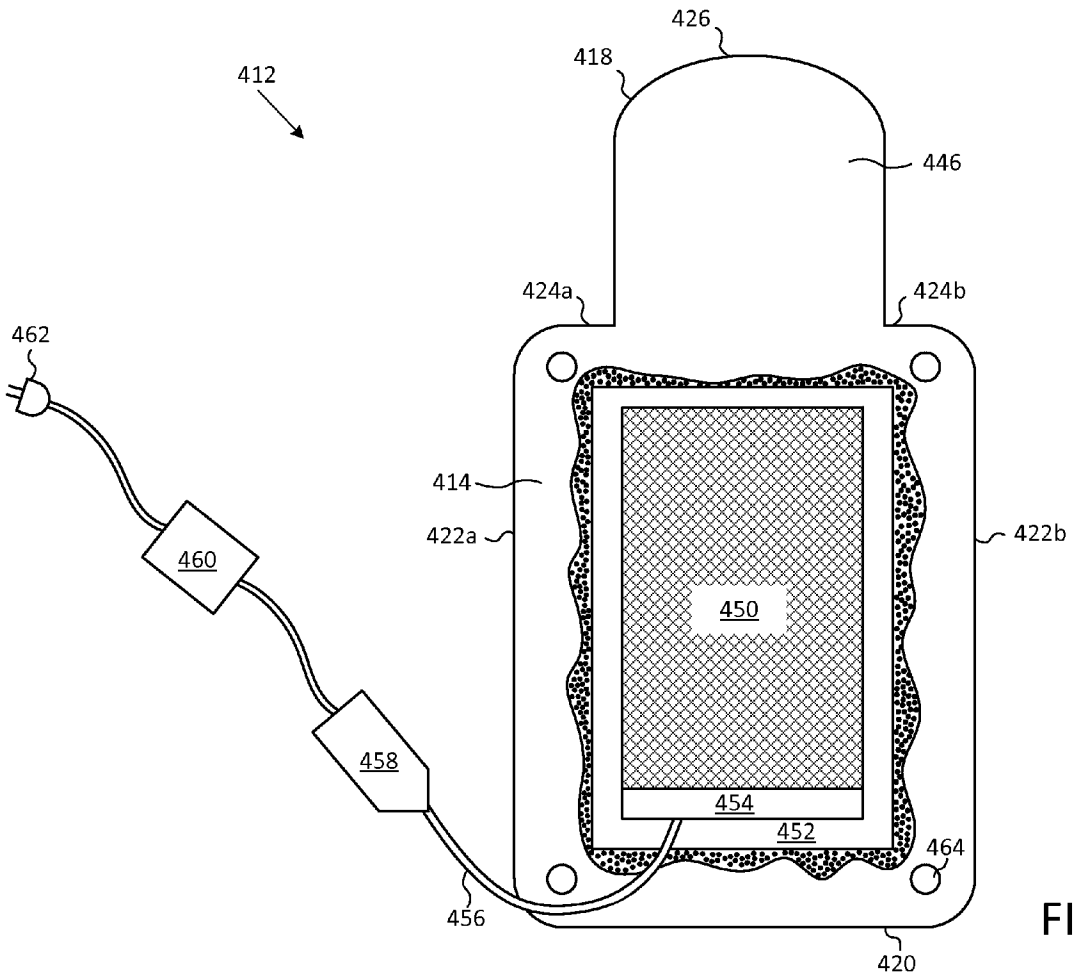
FIG. 17 is a plan view of an embodiment of a veterinary surgical positioning system that includes an electrical warming apparatus.
Figure 18:
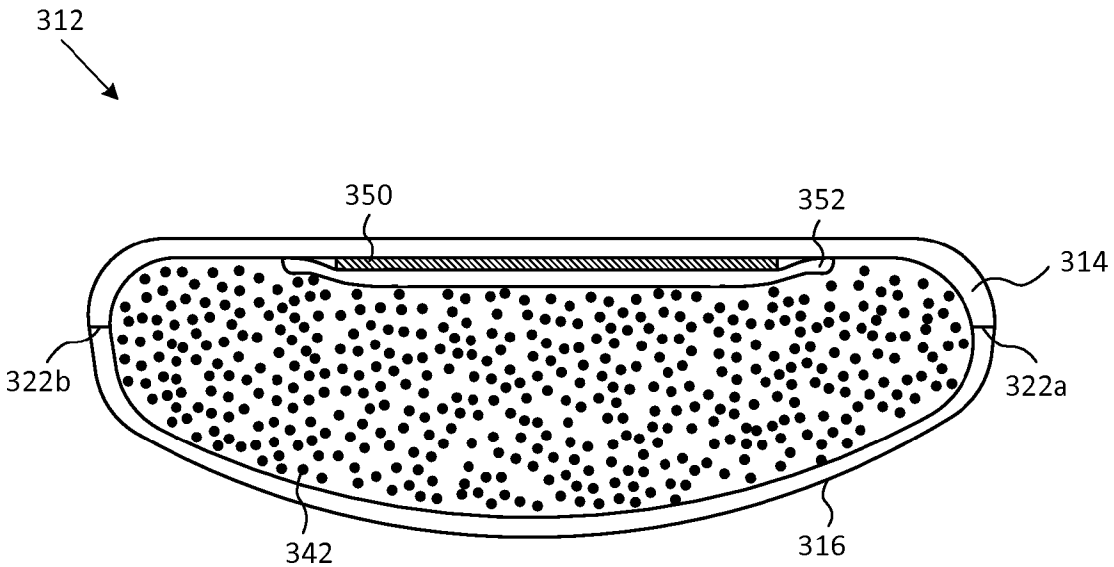
FIG. 18 is a cross-sectional view of the system shown in FIG. 16, taken along section line 18-18 shown in FIG. 16.
Figure 19:
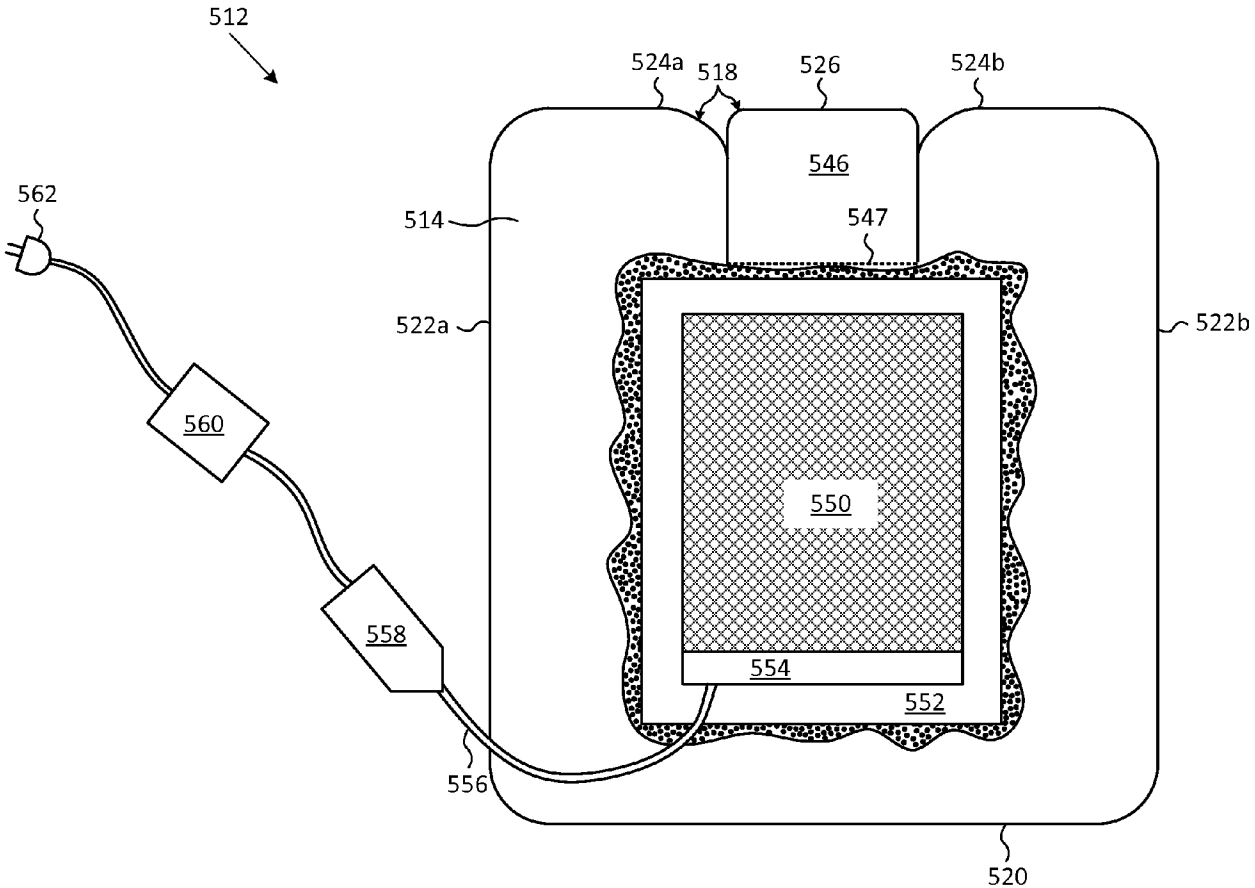
FIG. 19 is a plan view of an embodiment of another surgical positioning system that includes an electrical warming apparatus.

FIGS. 16-19 show exemplary embodiments of surgical positioning devices for positioning a patient and warming the patient during surgery. FIG. 16 shows an embodiment for use with human patients in a supine position, FIG. 17 shows an embodiment for use with non-human animal patients, and FIG. 19 shows an embodiment for use with human patients in a lateral position (resting on one side of the torso). FIG. 18 shows a cross-sectional view of the embodiment shown in FIG. 16.

As shown in FIGS. 16 and 18, the positioner 312 can comprise a flexible, air-impermeable shell comprising an upper wall 314, a lower wall 316, and an enclosed internal region between the upper and lower walls. The upper wall 314 comprises an outer surface configured to be positioned against a patient and to facilitate positioning the patient during surgery. The lower wall 316 is configured to rest against a support surface, such as a surgery table. A flexible electrical warming fabric 350 is coupled to the upper wall 314 of the shell, preferably the inner surface of the upper wall of the shell. The warming fabric 350 is shown as visible in FIGS. 16 and 17 for purposes of illustration, although preferably the warming fabric is hidden within the shell, as shown in FIG. 18, and is not visible or exposed. Positioning the warming fabric within the shell can help protect the fabric from exposure to liquids, metal or other materials that may short circuit the fabric and/or cause electrical shock.

The electrical warming fabric 350 is electrically couplable to an electrical power source, such as an AC power outlet, and configured to generate heat for warming the patient. The positioner further comprises a plurality of beads 342 (see FIG. 18) disposed in the internal region of the shell and an air valve coupled to the shell and operable to regulate air flow in and out of the internal region of the shell. The positioner is configured to conform to a shape of the patient upon deflation of the shell, as described above with reference to the surgical positioner shown in FIGS. 1-15.

The positioner 312 can further comprise an electrical power cord 356 coupled at a first end to the electrical warming fabric 350 and couplable at a second end to an electrical power source via a plug 362. The cord 356 can comprise an intermediate portion passing through the shell at an air-tight seam between the upper wall 314 and the lower wall 316. The power cord 356 can further comprise a heat controller 358 configured to control the amount of heat produced by the electrical warming fabric 350. The heat controller 358 can comprise a rheostatic heat controller, a digital heat controller, or other device for adjusting the current supplied to the fabric 350. The power cord 356 can further comprise an AC-to-DC converter 360 between the plug 362 and the heat controller 358. A busbar 354 can couple the first end of the cord 356 to the warming fabric 350. The busbar 354 can be configured to distribute current evenly across the fabric 350 to produce even heat production across the fabric.

The positioner 312 can further comprise at least one temperature sensor positioned within, or adjacent to, the upper wall 314 of the shell to measure the temperature at the contact surface with a patient. With the positioner 312 engaged with a patient, such a temperature sensor can be positioned between the electrical warming fabric 350 and the patient. The temperature sensor can provide feedback for the heat controller 358 to help control the amount of heat produced by the warming fabric 350 and to maintain a desired temperature at the interface of the patient and the upper wall 314. The temperature sensor can comprise a thermistor or other heat detection device.

The fabric 350 can comprise a plurality of resistive elements electrically coupled to the busbar 354 that are configured to convert electrical current into heat substantially evenly across the fabric. In one example, the electrical warming fabric 350 can comprise a semi-conductive polymeric fabric using low voltage direct current (~48V DC). The fabric 350 can comprise a rectangular configuration in some embodiments, as shown in FIG. 16, while the fabric can comprise various other shapes in other embodiments. An exemplary electrical warming fabric 350 is available from ThermoGear Inc., of Tualatin, Oreg., under the tradename ChillBuster®. Another exemplary warming fabric 350 is available from Augustine Biomedical+Design, of Eden Prairie, Minn., under the tradename ThermAssure™. Another exemplary warming fabric 350 is available from Augustine Temperature Management, of Eden Prairie, Minn., under the tradename Hot Dog®.

As shown in the cross-sectional view of FIG. 18, the electrical warming fabric 350 is preferably positioned with an upper major surface against the internal surface of the upper wall 314 of the shell. The width of the fabric 350 (i.e., the left-right dimension in FIG. 18) can vary from the entire width of the upper shell wall 314 to only a narrow portion of the width of the upper wall. Embodiments having a wider warming fabric 350 can be used for larger patients and/or for warming the sides and/or arms of the patient, whereas embodiments with a narrower warming fabric can be used for smaller patients and/or for only warming the torso of the patient.

As shown in FIG. 18, an adhesive layer 352 can be positioned within the shell and covering the lower major surface of the electrical warming fabric 350. As shown in FIG. 16, the adhesive layer 352 can comprise a peripheral portion that extends beyond the lateral edges of the electrical warming fabric 350 and is adhered to the lower surface of the upper wall 314 of the shell, the adhesive layer separating the electrical warming fabric from the beads 342 and securing the electrical warming fabric to the upper wall of the shell. The adhesive layer 352 can position the warming fabric 350 flush against the internal surface of the upper wall 314 without any material between the warming fabric and the upper wall 314 and without puncturing the upper wall, such as with sutures or other fasteners. In some embodiments, only the outer peripheral portion of the adhesive layer 352 comprises an adhesive material, whereas in other embodiments, the central portion of the adhesive layer can be adhered to the lower surface of the warming fabric 350.

In some embodiments, an additional insulation layer (not shown) can be disposed between the adhesive layer 352 and the warming fabric 350 to electrically and/or thermally insulate the lower surface of the warming fabric. Such an insulation layer can comprise muslin and/or other materials.

In alternative embodiments, the electrical warming fabric 350 can be held in place against the upper wall 314 of the shell by various other means instead of using the adhesive layer 352. In some embodiments, the electrical warming fabric 350 can be positioned within a pocket formed in the upper wall 314 of the shell. For example, an additional layer of the shell material, or the like, can be coupled to the bottom surface of the upper wall 314, such as by heat sealing or RF welding, to form a pocket and the electrical warming material 350 can be positioned in the pocket. Such a pocket can be used to hold the warming fabric in place instead of the adhesive layer 352.

The top and bottom opposing walls 314, 316 can be radio frequency welded, heat sealed, or otherwise joined together at their peripheral edges for strength and airtightness. When the patient is placed in the supine position on the positioner, as shown in FIG. 4, the lateral edges 322*a* and 322*b* can be folded up along the patient's neck, shoulders, arms, hips and/or upper thighs and packed snuggly against the patient's body to accommodate the natural contours thereof.

The top edge 318 includes two opposed shoulder edge portions 324*a*, 324*b*, and a pillow edge portion 326 located therebetween. Adjacent to the pillow edge portion 326, the shoulder edge portions 324*a*, 324*b* have a relatively tight radius of curvature, preferably about 4⅜ inch, allowing the top edge 318 to be folded upwardly adjacent either side of the patient's head and neck for support. As top edge 318 extends laterally outwardly toward lateral edges 322, the top edge retains an arc-like curvature but the radius of curvature of shoulder edge portions 324*a*, 324*b* increases significantly to expand the width of the shell and allow the top edge (when folded) to wrap around and at least partially overlie the patient's shoulders to support and immobilize the patient's upper body. The shoulder portions 324*a*, 324*b* of the upper edge 318 terminate where lateral edges 322*a*, 322*b* begin, defining the widest point of the shell.

The pillow or headrest portion 346 is preferably hingedly attached to the rest of the shell along a lateral line 347 such that the headrest portion 346 and the shoulder portions 324 can independently conform to the patient's head and shoulders.

Lateral edges 322*a*, 322*b* each define opposed cut-out portions 328*a*, 328*b*, and opposed projecting wrist supporting portions 330*a*, 330*b*. Wrist supporting portions 330*a*, 330*b* project outwardly to increase the width of the shell in the region proximate the bottom edge 320. The wrist supporting portions may be folded upwardly to provide lateral support for the patient's wrists and hands. They help secure the patient's wrists and hands against the side of the patient's body. The cut out portions 328*a*, 328*b* give the shell a tapered waist and low profile in the vicinity of the patient's arms so as to provide easy access to the patient's wrists and forearms for insertion of an IV, surgical access to the lower lateral abdomen, access for surgical instruments and other purposes. The bottom edge 320 preferably includes a central trapezoid-like cut out 332 to provide perineal access.

The warming fabric 350 is preferably located between the hinge line 347 and the bottom cut out 332, and between the lateral cut out portions 328*a*, 328*b*, as shown in FIG. 16.

The veterinary positioner 412 shown in FIG. 17 and the lateral positioner 512 shown in FIG. 19 are similar is most respects to the supine positioner 312 shown in FIG. 16, except that the shape of the shell can be different. Like the positioner 312, the veterinary positioner 412 can comprise a shell having a upper wall 414 and a lower wall 416 sealed together along a lateral periphery comprising a bottom edge 420, lateral edges 422*a*, 422*b*, and a top edge 418 comprising shoulder portions 424*a*, 424*b*, and a top portion 426 that borders a headrest 446.

Like the human positioner 312, the veterinary positioner 412 can also comprise an electrical warming fabric 450, an adhesive layer 452 covering the warming fabric, a busbar 454, a power cord 456, a heat controller 458, an AC-to-DC converter 460, and a plug 462. The veterinary positioner 412 can further comprise a plurality of apertures 464, as shown in FIG. 17. The apertures 464 can be formed so as not to communicate with the internal region of the shell. For example, the apertures 464 can be formed in corners of the shell where the top wall is sealed to the bottom wall. The apertures 464 can be used to attach straps for holding an animal's legs while the animal is in a supine position and the lateral sides of the positioner are upwardly engaged around the animal.

Embodiments of the veterinary positioner 412 can be shaped and sized in various manners to conform to various different types of animal patients. A cross-section of the veterinary positioner 412 (not shown) would appear generally the same as the cross-section of the human positioner 312 shown in FIG. 18.

The lateral positioner 512 shown in FIG. 19 is configured to position a human patient in a lateral position and comprises a shell having a upper wall 514 and a lower wall 516 sealed together along a lateral periphery comprising a bottom edge 520, lateral edges 522*a*, 522*b*, and a top edge 518 comprising shoulder portions 524*a*, 524*b*, and a top portion 526 that borders a headrest 546. The bottom, lateral, and top edges of the lateral positioner 512 can define a generally rectangular or square shape of the lateral positioner 512.

It should be understood that in other embodiments not shown, the shell can have any number of other shapes and configurations for various types of patients and/or procedures without departing from the scope of this disclosure.

Like the supine positioner 312, the lateral positioner 512 can also comprise an electrical warming fabric 550, an adhesive layer 552 covering the warming fabric, a busbar 554, a power cord 556, a heat controller 558, an AC-to-DC converter 560, and a plug 562.

Each of the positioner embodiments 312, 412, 512 can further comprise straps or other devices to secure the positioner to an operating table or other support structure below the positioner, in the same manner as described above with respect to the straps 38 (see FIG. 2).

In use, the positioners 312, 412, 512 can be used just like the embodiments 12 and 112 shown in FIGS. 1-15 to engage a patient by deflating the shell with the patient in a desired position and allowing the shell to conform around the patient's anatomy. In addition, the plug 362, 462, 562 can be plugged into an AC electrical outlet to supply power to the warming fabric. The AC-to-DC converter can convert the alternating current to direct current, significantly reducing the risk of shock damage and electrical fires and bums. An operator can use the heat controller to adjust the amount of heat generated by the warming fabric. Preferably, the heat controller is adjusted to maintain the patient and a stable temperature during surgery when the patient lacks the biological mechanisms to main the patient's body temperature. In some embodiments, temperature sensors can be included on or in the patient or adjacent to the upper wall of the shell to help monitor the patient's body temperature at different locations.

In alternative embodiments, the warming fabric can be coupled to a mobile DC power source, such as a battery, to provide improved mobility of the positioner.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope of these claims.

I claim:

1. A surgical positioning device for positioning the body of a patient, the device comprising:

a flexible, air-impermeable shell comprising an upper wall, a lower wall, and an enclosed internal region between the upper and lower walls, the upper wall having an outer surface configured to facilitate positioning the patient and an inner surface, the lower wall configured to rest against a support surface;

a flexible electrical warming fabric coupled to the inner surface of the upper wall of the shell, the electrical warming fabric being electrically couplable to an electrical power source and configured to generate heat for warming the patient through the upper wall of the shell;

a plurality of beads disposed in the internal region of the shell; and an air valve coupled to the shell and operable to regulate air flow in and out of the internal region of the shell, wherein the surgical positioning device is configured to conform to a shape of the patient upon deflation of the shell.

2. The device of claim 1, further comprising an electrical power cord coupled at a first end to the electrical warming fabric and couplable at a second end to an electrical power source, and comprising an intermediate portion passing through the shell at an air-tight seam between the upper and lower walls.

3. The device of claim 2, wherein the electrical power cord further comprises a heat controller between the power source and the electrical heating fabric, the heat controller configured to control the amount of heat produced by the electrical warming fabric.

4. The device of claim 3, wherein the electrical power cord further comprises an AC plug at the second end and an AC-to-DC converter between the heat controller and the second end.

5. The device of claim 2, further comprising a busbar coupling the first end of the power cord to the electrical warming fabric, the busbar configured to distribute electricity across the electrical warming fabric.

6. The device of claim 1, wherein the electrical warming fabric comprises an upper surface in contact with the lower surface of the upper wall of the shell and a lower surface, the device further comprising an adhesive layer positioned within the shell and covering the lower surface of the electrical warming fabric, the adhesive layer comprising a peripheral portion that extends beyond lateral edges of the electrical warming fabric and is adhered to the lower surface of the upper wall of the shell, the adhesive layer separating the electrical warming fabric from the beads and securing the electrical warming fabric to the upper wall of the shell.

7. The device of claim 6, further comprising an insulation layer positioned between the electrical warming fabric and the adhesive layer.

8. The device of claim 1, wherein the device is configured for positioning and warming a non-human animal patient during surgery.

9. The device of claim 1, wherein the shell and the electrical warming fabric have a width greater than a width of the patient such that the device is configured to, upon deflation, wrap around and warm lower and side portions of the patient while leaving upper portions of the patient uncovered.

10. The device of claim 1, further comprising at least one strap secured to an outer surface of the bottom wall for fastening the surgical positioning device to the support surface.

11. The device of claim 1, wherein the upper wall of the shell comprises a central region for supporting the patient's torso and at least a portion of the electrical warming fabric is positioned against the central region of the upper wall.

12. The device of claim 1, wherein the device comprises opposing first and second shoulder support regions configured to upwardly engage the patient's shoulders.

13. The device of claim 1, wherein the device comprises a recessed perineal access region for providing access to the patient's perineal region.

14. The device of claim 1, wherein the device comprises opposing first and second laterally extending hand or wrist support regions configured to upwardly engage the patients hands or wrists, and opposing adjacent first and second recessed forearm access regions configured to allow access to the patient's forearms or abdomen.

15. The device of claim 1, wherein the device comprises a head support portion for supporting the patient's head.

16. A method of positioning and warming a patient during surgery, the method comprising:

positioning a surgical positioner between a patient and a support surface with the patient being in a selected position for surgery, the positioner comprising a shell, an electrical warming material coupled to an internal surface of the shell, and a plurality of beads within the shell;

evacuating air from the shell such that the positioner fittingly engages lower and side portions of the patient to hold the patient in the selected position; and supplying direct electrical current to the electrical warming material to warm the patient through the shell of the positioner.

17. The method of claim 16, further comprising adjusting the electrical current to the electrical warming material to maintain the patient's body temperature within a selected range.

18. The method of claim 16, wherein supplying direct electrical current to the electrical warming fabric comprises converting alternating electrical current to direct electrical current.

19. The method of claim 16, wherein the patient is a non-human animal.

20. A surgical positioning device comprising:

a flexible shell defining a deflatable air-tight internal region, the shell comprising an outer surface configured for positioning against the patient during surgery;

an electrical warming material coupled to the shell, the electrical warming material being configured to convert direct electrical current into heat for warming the patient during surgery; and a plurality of beads disposed within the internal region of the shell;

wherein the surgical positioning device is configured to engage lower and side portions of the patient upon deflation of the shell to hold the patient in a selected position during surgery.

* * * * *